US011711661B2

(12) United States Patent
Iseberg

(10) Patent No.: US 11,711,661 B2
(45) Date of Patent: Jul. 25, 2023

(54) CONFORMABLE VENTED EARTIP

(71) Applicant: Team IP Holdings, LLC, Fort Worth, TX (US)

(72) Inventor: Steve Iseberg, Crystal Lake, IL (US)

(73) Assignee: TEAM IP HOLDINGS, LLC, Fort Worth, TX (US)

( * ) Notice: Subject to any disclaimer, the term of this patent is extended or adjusted under 35 U.S.C. 154(b) by 0 days.

(21) Appl. No.: 17/495,006

(22) Filed: Oct. 6, 2021

(65) Prior Publication Data

US 2022/0360919 A1 Nov. 10, 2022

Related U.S. Application Data

(60) Provisional application No. 63/184,579, filed on May 5, 2021.

(51) Int. Cl.
*H04R 25/00* (2006.01)
*H04R 1/10* (2006.01)

(52) U.S. Cl.
CPC ..... *H04R 25/652* (2013.01); *H04R 1/1016* (2013.01); *H04R 2460/11* (2013.01)

(58) Field of Classification Search
CPC ..... H04R 1/1016; H04R 1/12; H04R 25/656; H04R 25/654
See application file for complete search history.

(56) References Cited

U.S. PATENT DOCUMENTS

| | | | | |
|---|---|---|---|---|
| 9,088,847 | B2 * | 7/2015 | Young-Mun | H04R 1/1058 |
| D756,970 | S * | 5/2016 | Ferber | D14/223 |
| 2002/0027996 | A1 | 3/2002 | Leedom et al. | |
| 2021/0076145 | A1 | 3/2021 | Junke | |

OTHER PUBLICATIONS

PCT Invitation to Pay Additional Fees for International Application No. PCT/US202/015043 dated May 25, 2022, 13 pages.
PCT International Search Report and the Written Opinion of the International Searching Authority, or the Declaration for International Application No. PCT/US202/015043 dated Jul. 18, 2022, 20 pages.

* cited by examiner

*Primary Examiner* — Amir H Etesam
(74) *Attorney, Agent, or Firm* — McAndrews, Held & Malloy, Ltd.

(57) ABSTRACT

Conformable vented eartips are provided. A comfortable vented eartip includes an ear insertion end, an earphone insertion end opposite the ear insertion end, a base at the ear insertion end extending toward the earphone extension end, a central opening extending through the base to form an inner sound channel through the base, and at least one flange. The at least one flange includes a first flange end extending from the base at an angle away from the base and toward the earphone insertion end at a second flange end. The at least one flange includes at least one swept indent extending between the first flange end and the second flange end. The at least one swept indent sweeps laterally around a portion of a circumference of the at least one flange.

19 Claims, 23 Drawing Sheets

CONFORMABLE VENTED EARTIP

CROSS-REFERENCE TO RELATED APPLICATIONS/INCORPORATION BY REFERENCE

The present application claims priority under 35 U.S.C. § 119(e) to provisional application Ser. No. 63/184,579 filed on May 5, 2021, entitled "CONFORMABLE VENTED EARTIP." The above referenced provisional application is hereby incorporated herein by reference in its entirety.

FIELD

The present disclosure relates to earphone and hearing aid eartips. More specifically, the present disclosure relates to conformable vented eartips having an inner, primary sound channel configured to receive a sound tube of an earphone or hearing aid, and outer acoustic apertures or pathways provided by a series of swept indents in an outer flange of the eartips configured to maintain a secondary acoustic channel to an ambient environment as the outer flange profile conforms to contour of the ear canal.

BACKGROUND

Eartips for coupling audio to the ear canal, which are commonly found on earphones and hearing aids, have been made in many configurations and of many materials. These eartips are typically intended to adapt to a range of ear canal sizes and are not commonly custom for a particular ear canal.

Eartips are typically provided as either a sealing-type or a vented-type, irrespective of the intended acoustic path through the eartip. Eartips of the sealing-type are intended to block the acoustic path across the eartip. Eartips of the vented-type have acoustic pathways across the eartip to allow acoustic transfer from an ambient environment across the eartip.

There are many styles of eartips found on commonly available earphones and hearing aids, typically comprised of a foam or elastomer material. The particular characteristics of the material used, such as durometer or density, have a significant impact on the ability of the eartip to conform to the individual ear canal, the comfort reported by the user of the eartip, and the isolation from external sound. The particular design of the eartip can have an even greater impact on its ability to conform to the ear canal and its comfort for the user.

Existing eartips may cause discomfort for a variety of reasons. One factor causing discomfort when using existing eartips is pressure on the ear canal or tympanic membrane caused by the eartip unyieldingly pressing against the ear canal wall as the eartip is inserted deeper into the ear canal. Another factor causing discomfort includes pressure applied to the ear canal by the eartip material being less yielding than the ear canal as the eartip tries to return to its nominal shape. For example, foam eartips are typically compressed before insertion. Once inserted, the foam eartip attempts to recover to its pre-compressed shape, which applies pressure to the ear canal that may cause discomfort.

An additional factor causing discomfort when using existing eartips is unyielding shapes or materials. For example, edges of flanges can cause discomfort as the eartip relaxes to its nominal shape after insertion, causing the edge of the flange to settle into the ear canal wall. There are many existing eartip designs that require the users' ear canal to conform to the eartip, rather than the eartip conforming to the users' ear canal, causing immediate and/or eventual discomfort with use of the device. Another factor causing discomfort includes eartip designs that require insertion deep in an ear canal of the user, which may be uncomfortable for some users.

Further limitations and disadvantages of conventional and traditional approaches will become apparent to one of skill in the art, through comparison of such systems with some aspects of the present disclosure as set forth in the remainder of the present application.

SUMMARY

Certain embodiments of the present technology provide conformable vented eartips having an inner, primary sound channel configured to receive a sound tube of an earphone or hearing aid, and outer acoustic apertures or pathways provided by a series of swept depressions in an outer flange of the eartips configured to maintain a secondary acoustic channel to an ambient environment, substantially as shown in and/or described in connection with at least one of the figures.

These and other advantages, aspects and novel features of the present disclosure, as well as details of an illustrated embodiment thereof, will be more fully understood from the following description and drawings.

DETAILED DESCRIPTION

Figure 1:
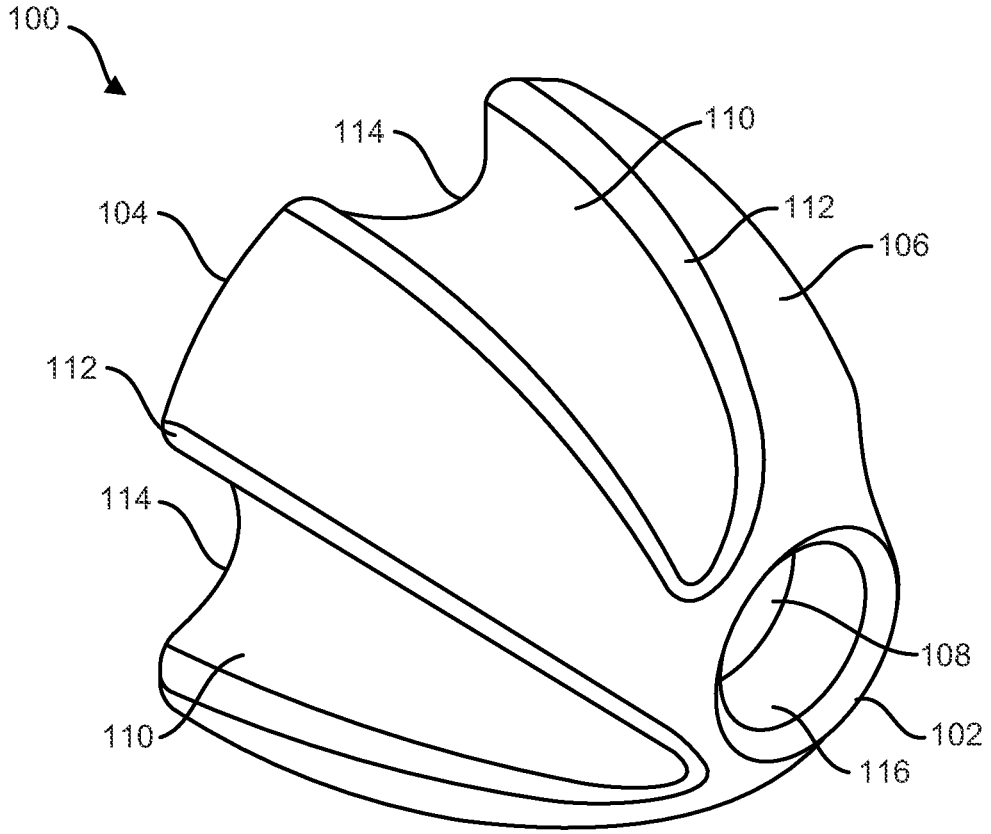
FIG. 1 depicts a front perspective view of an exemplary single-flange conformable vented eartip having four sloped ventilation channels configured to maintain a secondary acoustic channel to an ambient environment, in accordance with various embodiments.

Embodiments of the present technology provide an eartip that can conform comfortably to the individual ear canal while providing secondary acoustic pathways across the eartip to allow acoustic transfer from an ambient environment across the eartip.

The foregoing summary, as well as the following detailed description of certain embodiments will be better understood when read in conjunction with the appended drawings. It should be understood that the various embodiments are not limited to the arrangements and instrumentality shown in the drawings. It should also be understood that the embodiments may be combined, or that other embodiments may be utilized and that structural changes may be made without departing from the scope of the various embodiments of the present disclosure. The following detailed description is, therefore, not to be taken in a limiting sense.

As used herein, an element or step recited in the singular and proceeded with the word "a" or "an" should be understood as not excluding the plural of the elements or steps, unless such exclusion is explicitly stated. Furthermore, references to "an embodiment," "one embodiment," "a representative embodiment," "an exemplary embodiment," "various embodiments," "certain embodiments," and the like are not intended to be interpreted as excluding the existence of additional embodiments that also incorporate the recited features. Moreover, unless explicitly stated to the contrary, embodiments "comprising," "including," or "having" an element or a plurality of elements having a particular property may include additional elements not having that property.

Figure 2:
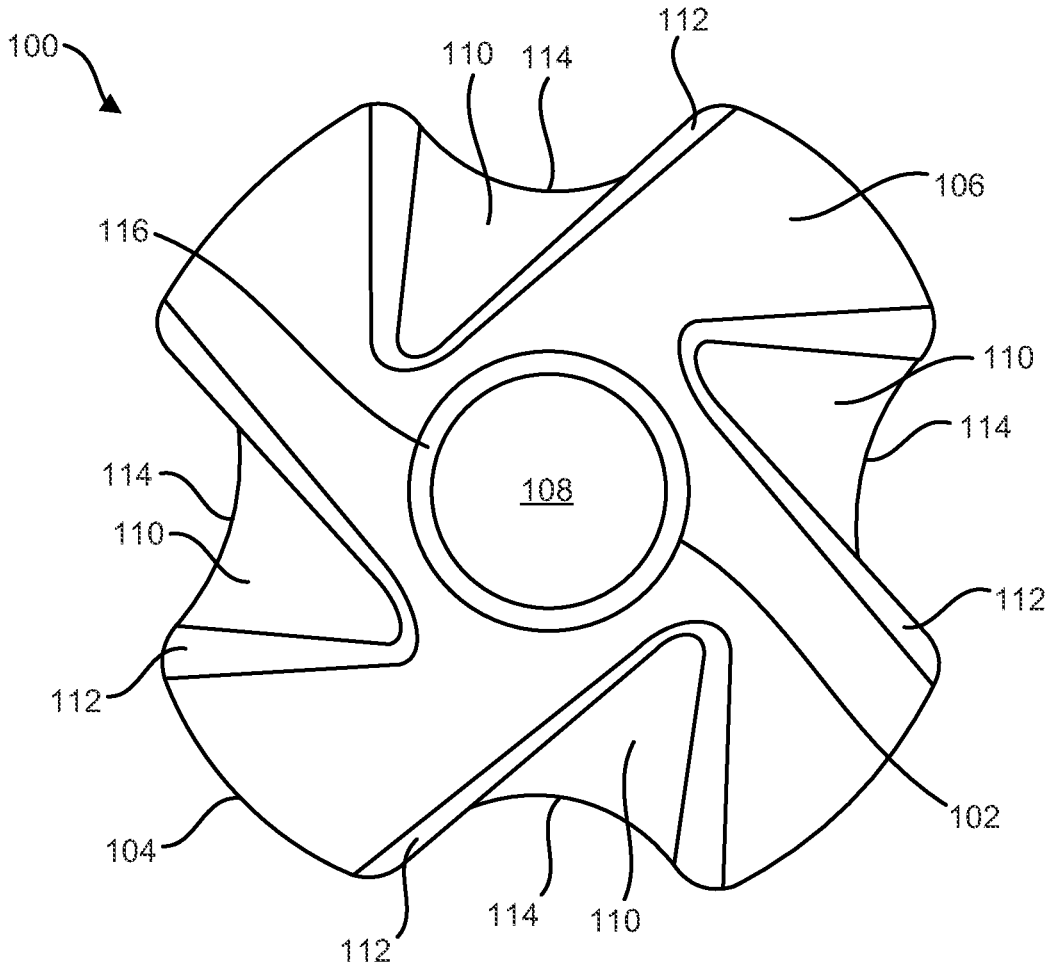
FIG. 2 depicts a top view of an exemplary single-flange conformable vented eartip having four sloped ventilation channels configured to maintain a secondary acoustic channel to an ambient environment, in accordance with various embodiments.
Figure 3:
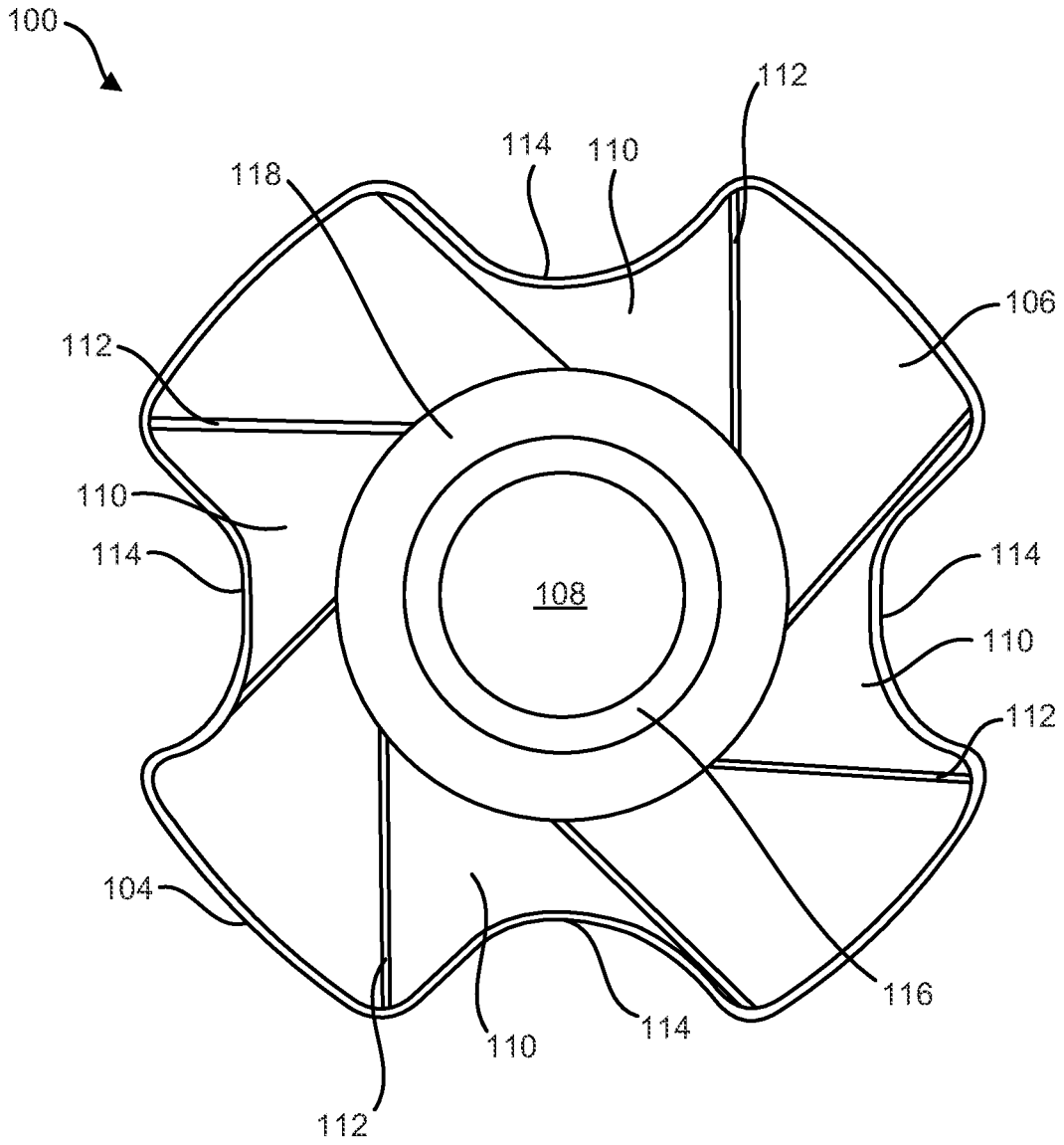
FIG. 3 depicts a bottom view of an exemplary single-flange conformable vented eartip having a stem configured to receive a sound tube of an earphone or hearing aid, and with four sloped ventilation channels configured to maintain a secondary acoustic channel to an ambient environment, in accordance with various embodiments.
Figure 4:
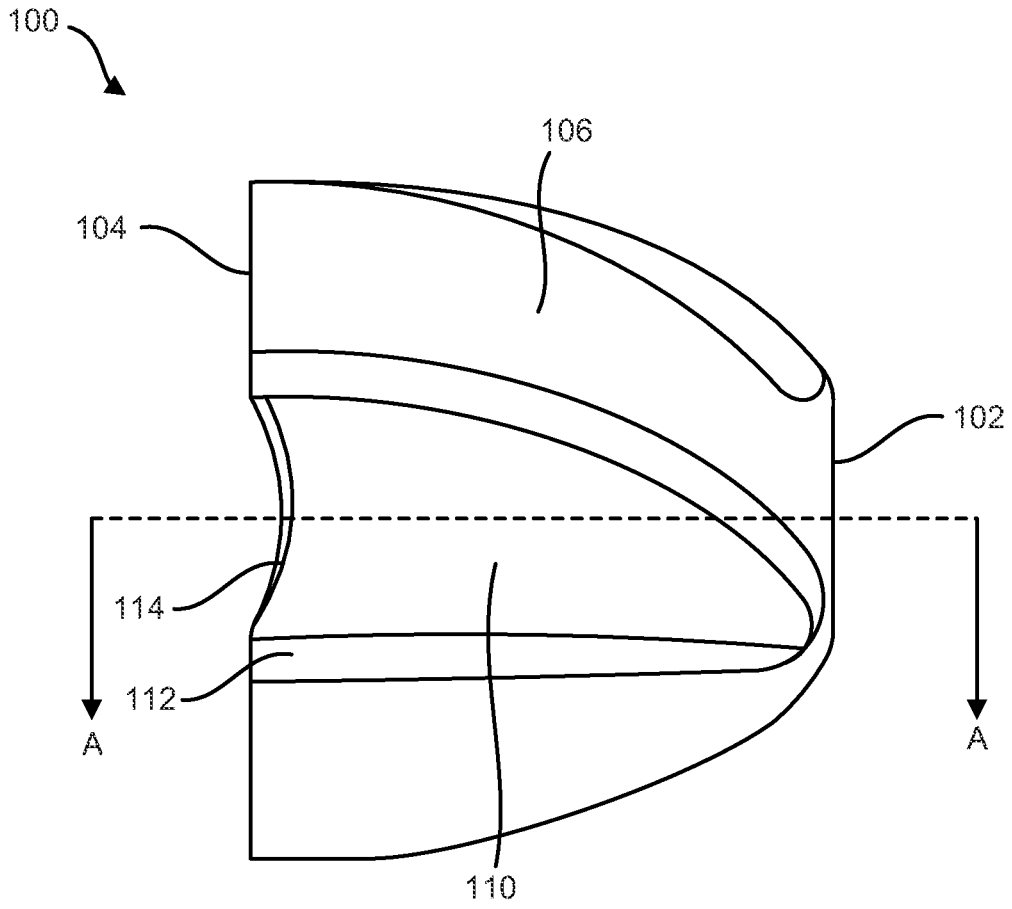
FIG. 4 depicts a side elevation view of an exemplary single-flange conformable vented eartip having four sloped ventilation channels configured to maintain a secondary acoustic channel to an ambient environment, in accordance with various embodiments.
Figure 5:
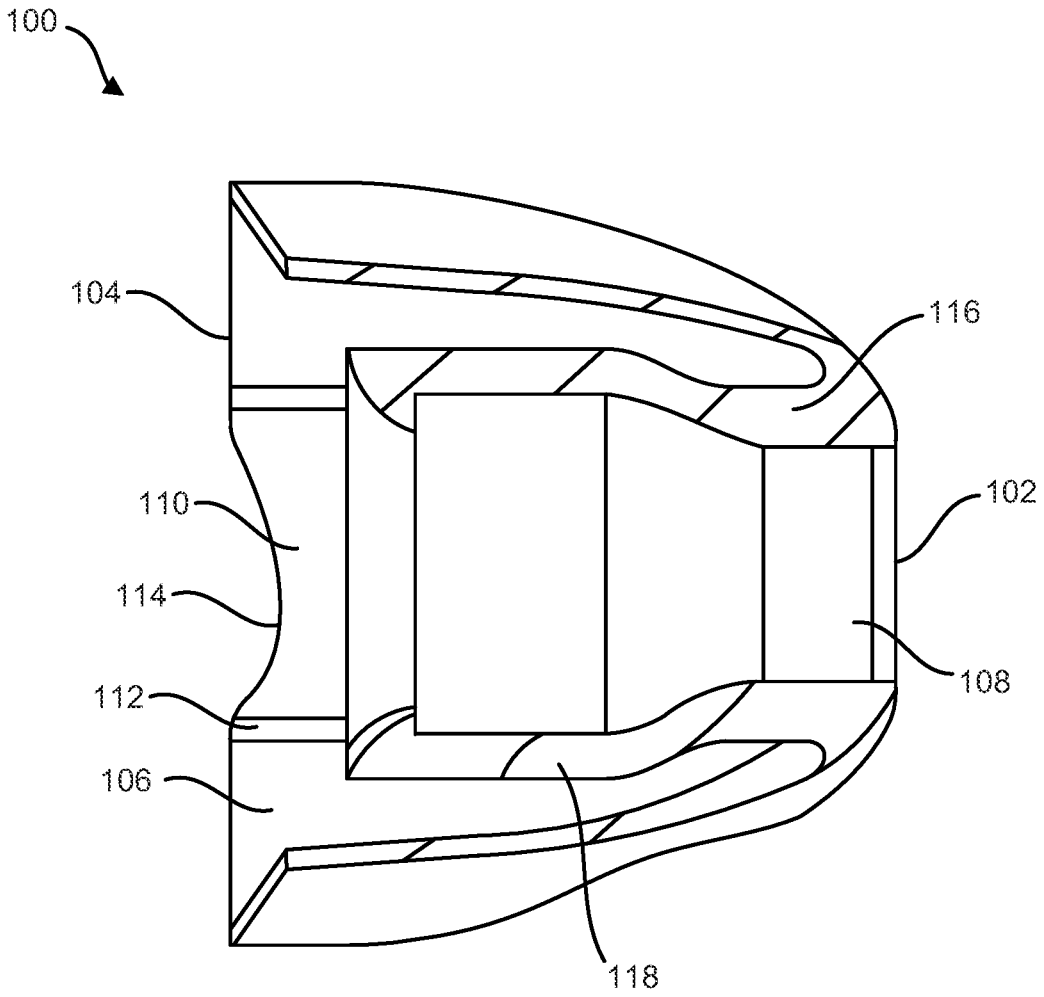
FIG. 5 depicts a cross-sectional view along line A-A of FIG. 4 of an exemplary single-flange conformable vented eartip having a stem configured to receive a sound tube of an earphone or hearing aid, and with four sloped ventilation channels configured to maintain a secondary acoustic channel to an ambient environment, in accordance with various embodiments.
Figure 6:
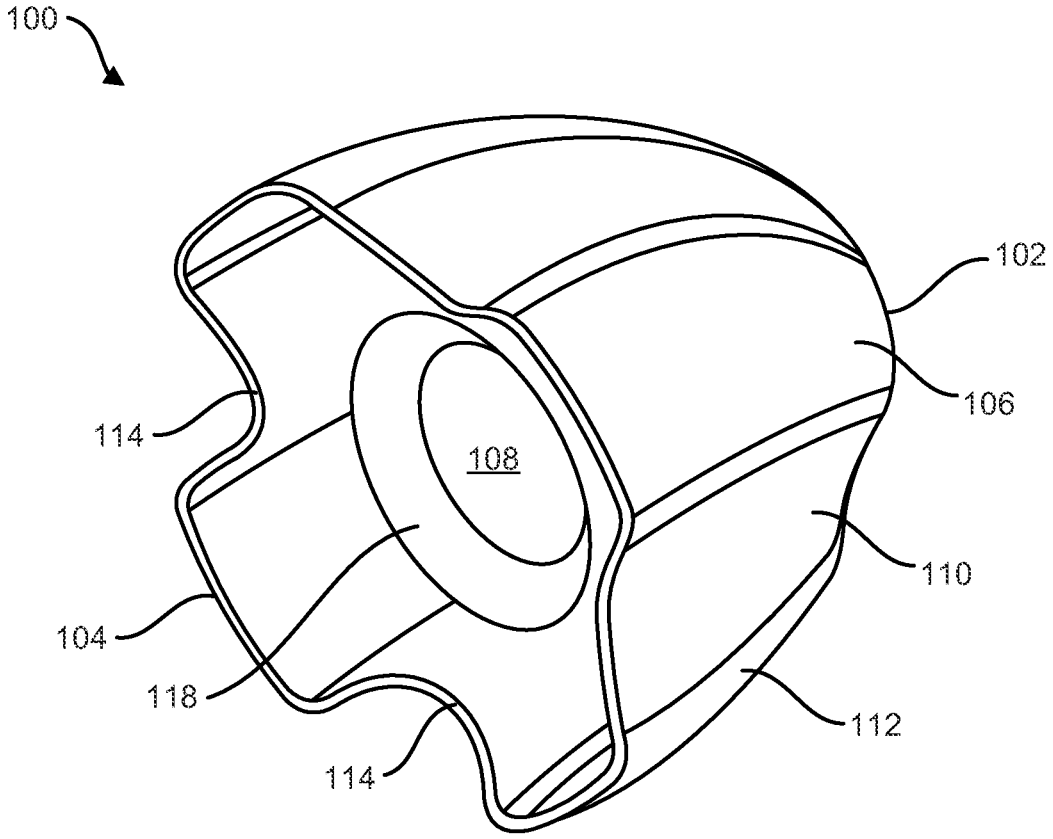
FIG. 6 depicts a rear perspective view of an exemplary single-flange conformable vented eartip having a stem configured to receive a sound tube of an earphone or hearing aid, and with four sloped ventilation channels configured to maintain a secondary acoustic channel to an ambient environment, in accordance with various embodiments.
Figure 7:
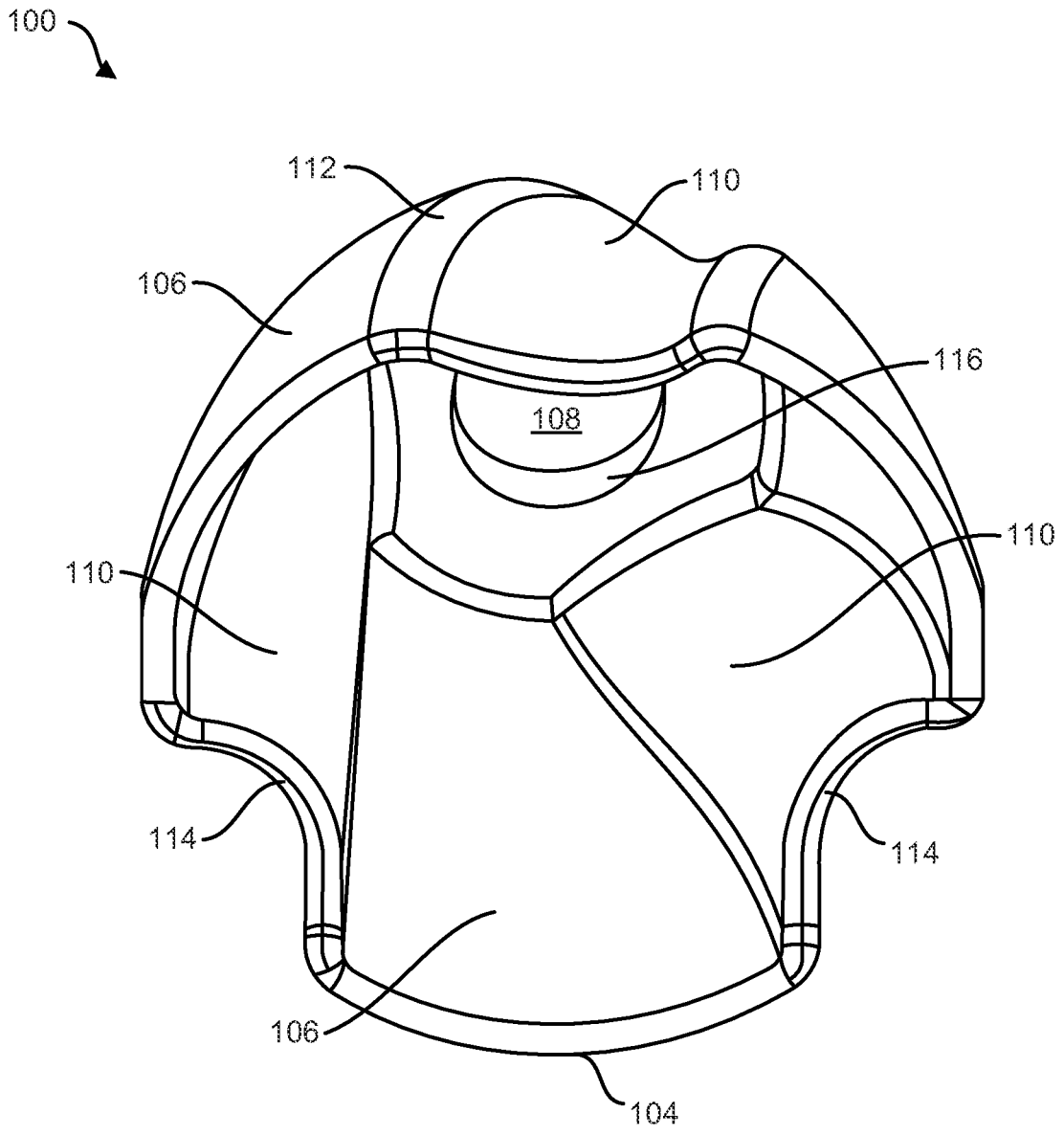
FIG. 7 depicts a rear perspective views of an exemplary single-flange conformable vented eartip having a collar configured to receive a sound tube of an earphone or hearing aid, and with three sloped ventilation channels configured to maintain a secondary acoustic channel to an ambient environment, in accordance with various embodiments.
Figure 8:
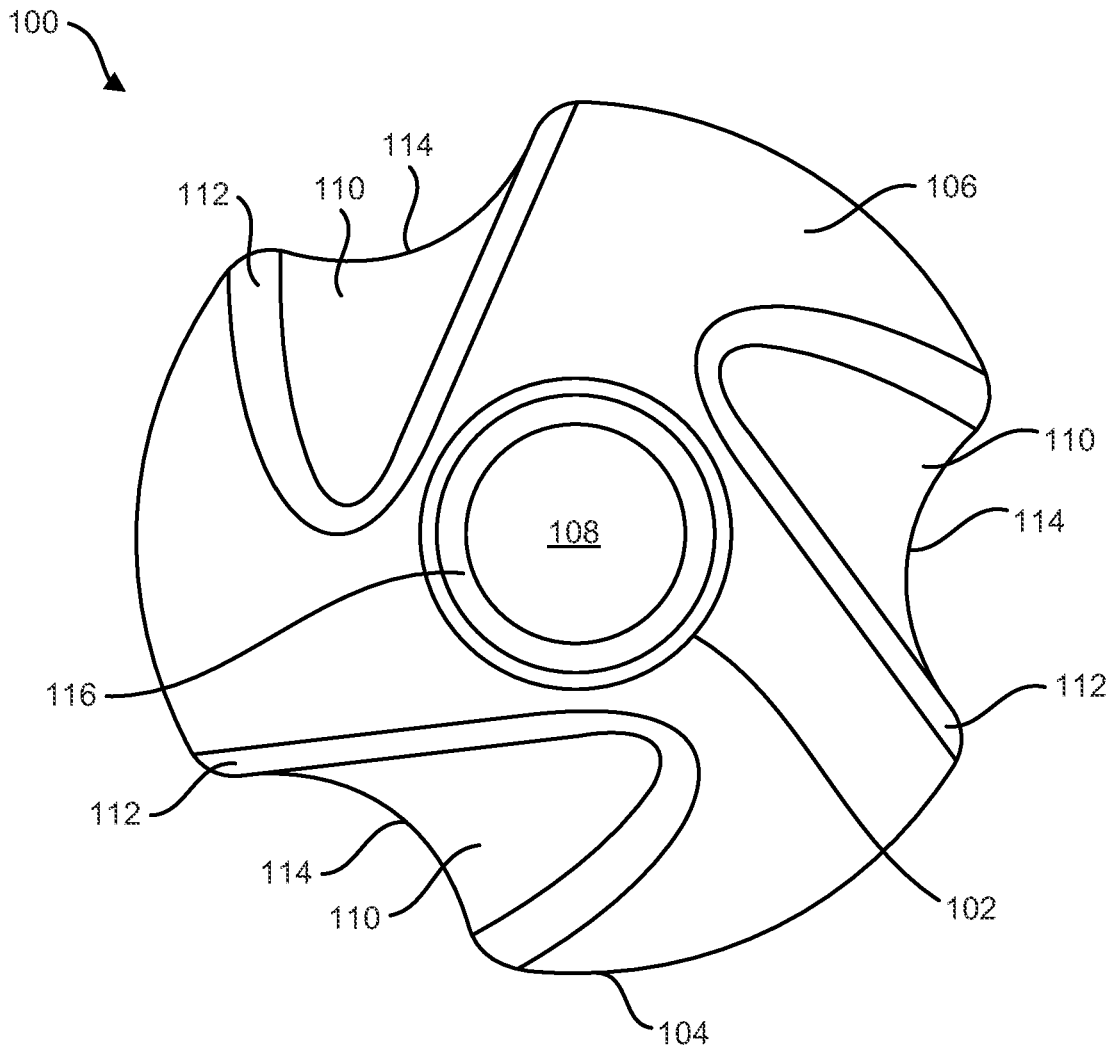
FIG. 8 depicts a top view of an exemplary conformable vented eartip having three sloped ventilation channels configured to maintain a secondary acoustic channel to an ambient environment, in accordance with various embodiments.
Figure 9:
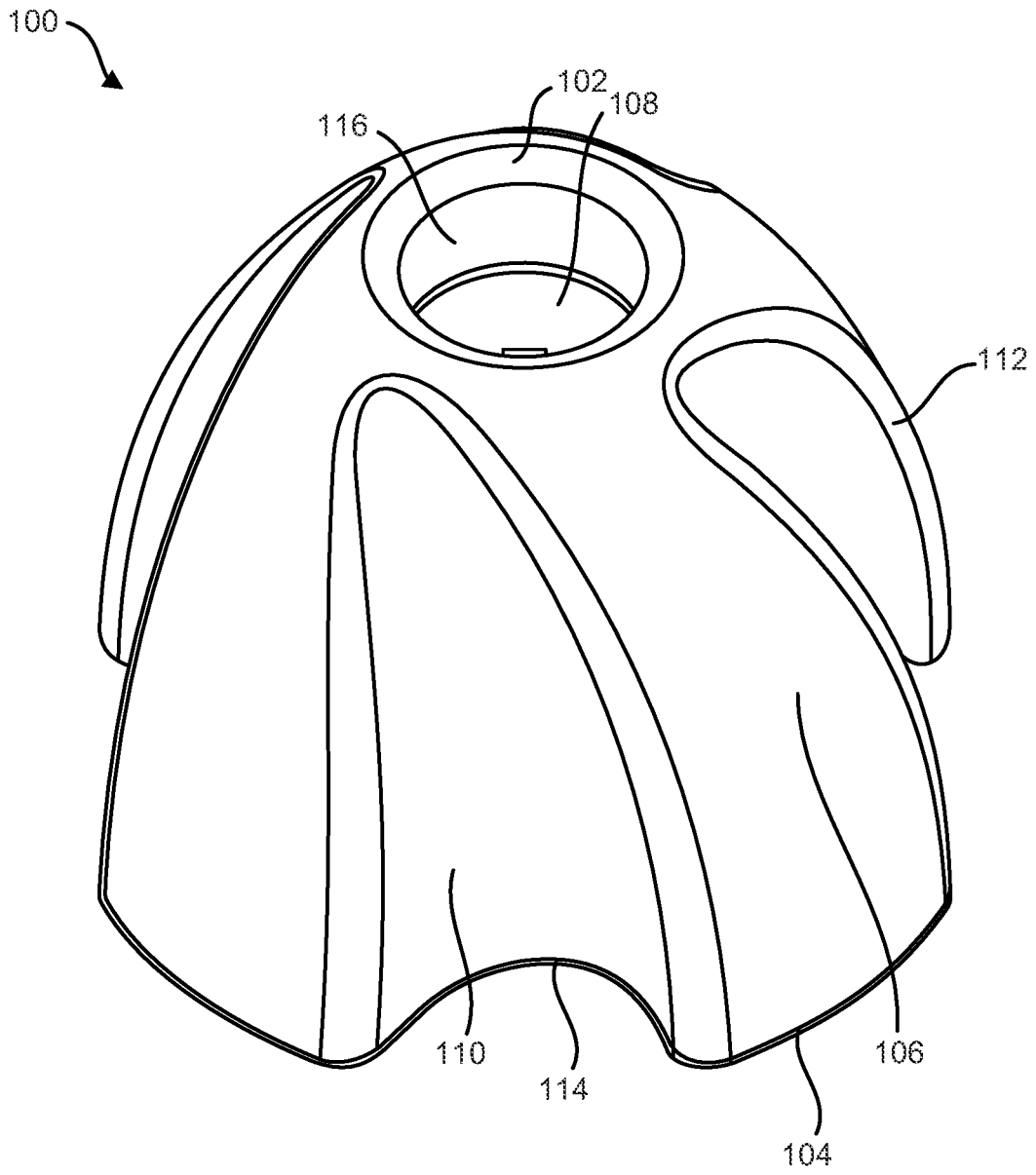
FIG. 9 depicts a top perspective view of an exemplary single-flange conformable vented eartip having four clockwise sloped ventilation channels configured to maintain a secondary acoustic channel to an ambient environment, in accordance with various embodiments.

FIG. 1 depicts a front perspective view of an exemplary single-flange conformable vented eartip 100 having four sloped ventilation channels 110 configured to maintain a secondary acoustic channel 120 to an ambient environment, in accordance with various embodiments. FIG. 2 depicts a top view of an exemplary single-flange conformable vented eartip 100 having four sloped ventilation channels 110 configured to maintain a secondary acoustic channel 120 to an ambient environment, in accordance with various embodiments. FIG. 3 depicts a bottom view of an exemplary single-flange conformable vented eartip 100 having a stem 118 configured to receive a sound tube of an earphone or hearing aid, and with four sloped ventilation channels 110 configured to maintain a secondary acoustic channel 120 to an ambient environment, in accordance with various embodiments. FIG. 4 depicts a side elevation view of an exemplary single-flange conformable vented eartip 100 having four sloped ventilation channels 110 configured to maintain a secondary acoustic channel 120 to an ambient environment, in accordance with various embodiments. FIG. 5 depicts a cross-sectional view along line A-A of FIG. 4 of an exemplary single-flange conformable vented eartip 100 having a stem 118 configured to receive a sound tube of an earphone or hearing aid, and with four sloped ventilation channels 110 configured to maintain a secondary acoustic channel 120 to an ambient environment, in accordance with various embodiments. FIG. 6 depicts a rear perspective view of an exemplary single-flange conformable vented eartip 100 having a stem 118 configured to receive a sound tube of an earphone or hearing aid, and with four sloped ventilation channels 110 configured to maintain a secondary acoustic channel 120 to an ambient environment, in accordance with various embodiments. FIG. 7 depicts a rear perspective views of an exemplary single-flange conformable vented eartip 100 having a collar 116 configured to receive a sound tube of an earphone or hearing aid, and with three sloped ventilation channels 110 configured to maintain a secondary acoustic channel 120 to an ambient environment, in accordance with various embodiments. FIG. 8 depicts a top view of an exemplary conformable vented eartip 100 having three sloped ventilation channels 110 configured to maintain a secondary acoustic channel 120 to an ambient environment, in accordance with various embodiments. FIG. 9 depicts a top perspective view of an exemplary single-flange conformable vented eartip 100 having four clockwise sloped ventilation channels 110 configured to maintain a secondary acoustic channel 120 to an ambient environment, in accordance with various embodiments.

Referring to FIGS. 1-9, single-flange conformable vented eartips 100 are shown. The conformable vented eartips 100 may be made of an elastomer material, such as silicone, or any suitable material. The conformable vented eartips 100 may include an ear insertion end 102 and an earphone insertion end 104 opposite the ear insertion end 102. The conformable vented eartips 100 may include at least one flange 106 and a base 116, 118 having an eartip collar 116. In various embodiments, an eartip stem 118 may extend from the eartip collar 116 (as shown in FIGS. 3, 5, and 6). Alternatively, the eartip 100 may include an eartip collar 116 without an eartip stem 118 (as shown in FIG. 7). The eartip collar 116 and stem 118 (if present) includes a central opening 108 extending from the ear insertion end 102 toward the earphone insertion end 104 to form an inner, primary sound channel 108. The eartip collar 116 and/or stem 118 (if present) may be configured to receive and hold a sound tube of an earphone or hearing aid within the inner, primary sound channel 108. For example, the eartip collar 116 and/or stem 118 (if present) may be shaped to receive a sound tube of an earphone or hearing aid at a particular position and/or orientation within the inner, primary sound channel. As an example, the central opening 108 may include a portion for receiving a head of an earphone tube and a portion for receiving a body of the earphone tube. The collar 116 and stem 118 (if present) forming the inner, primary sound channel 108 within the eartip 100 is configured to receive and hold an attached hearing instrument within the ear canal via the at least one conformable flange 106 configured to provide a small but adequate outward pressure against the ear canal wall. This outward pressure creates a resistance to movement, keeping the hearing device stable in the placed location.

The at least one flange 106 may extend from the base 116, 118 at the ear insertion end 102 at an angle away from the base 116, 118 and toward the earphone insertion end 104. Integrated into the at least one flange 106 of the eartip are a series of swept indents 110 (also referred to as swept depressions and swept ventilation channels) leading from the narrower inserted end 102 of the eartip 100 towards the larger end of the flange 106, maintaining a depression 110 relative to the outer circumference, which follows the outward taper of the flange 106 while sweeping laterally around the circumference. The transition between the outer surface of the flange 106 and the swept depressions 110 may comprise rounded corners 112. The swept depressions 110 of the flange 106 may be notched 114 at the earphone insertion end 104. Although four (4) swept depressions 110 are shown in FIGS. 1-6 and three (3) swept depressions 110 are shown in FIGS. 7-8, more (e.g., 5-10) or less (e.g., 1-2) swept depressions 110 are contemplated. Although the swept indents 110, as shown in FIGS. 1-8, follow a counterclockwise path, swept indents 110 along a clockwise path is also envisioned as an alternate embodiment as shown in FIG. 9. In various embodiments, the angle and length of the path of the swept indents 110 may vary. Moreover, the depth and taper of the depth along the path of the swept indent 110 may be configured to provide larger or smaller acoustic channels 120. Furthermore, the swept indents 110 may be configured to provide the acoustic channels 120 on an eartip 100 designed to accommodate larger or smaller ear canal contours.

Figure 10:
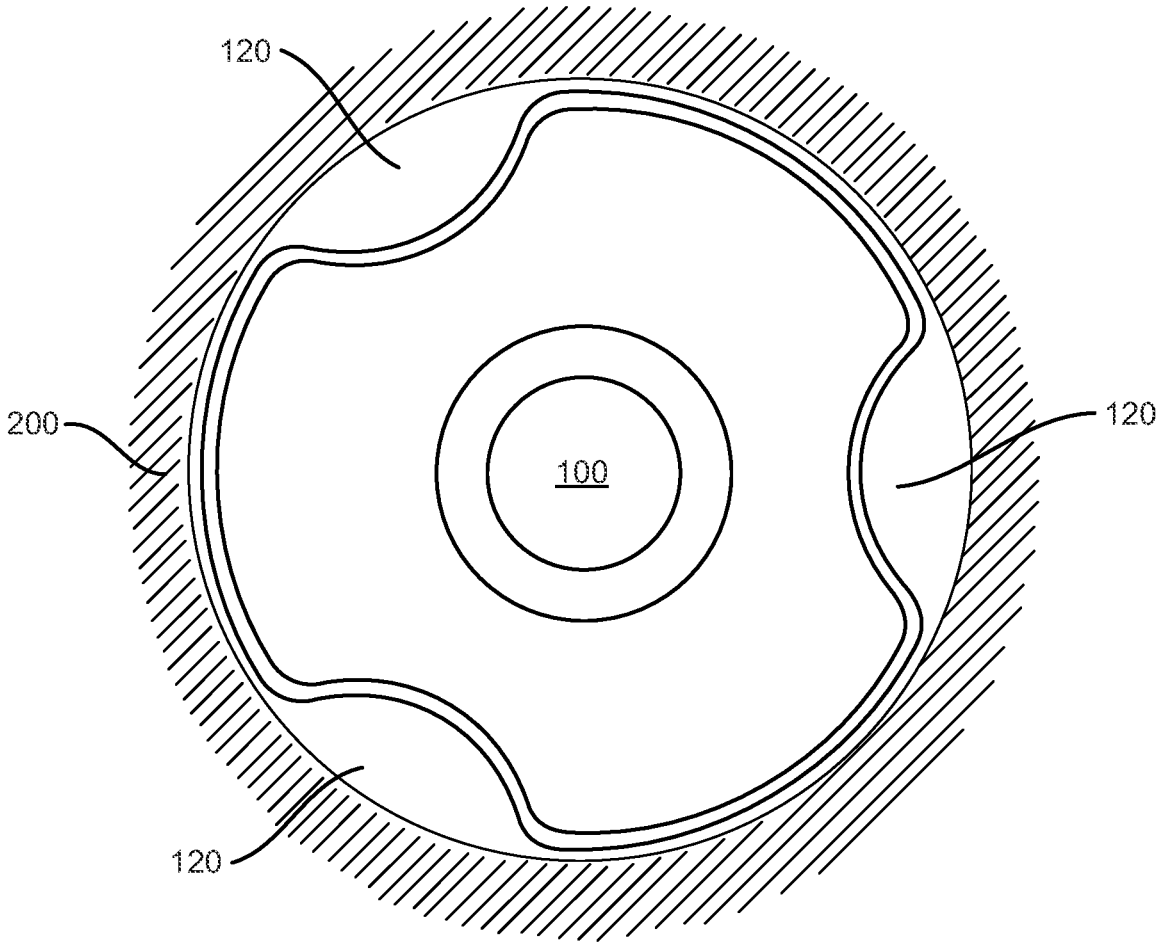
FIG. 10 depicts a cross-sectional view, in a simplified condition, illustrating a compliance of the swept ventilation channels as the eartip conforms to a large diameter to form a secondary acoustic channel, in accordance with various embodiments.
Figure 11:
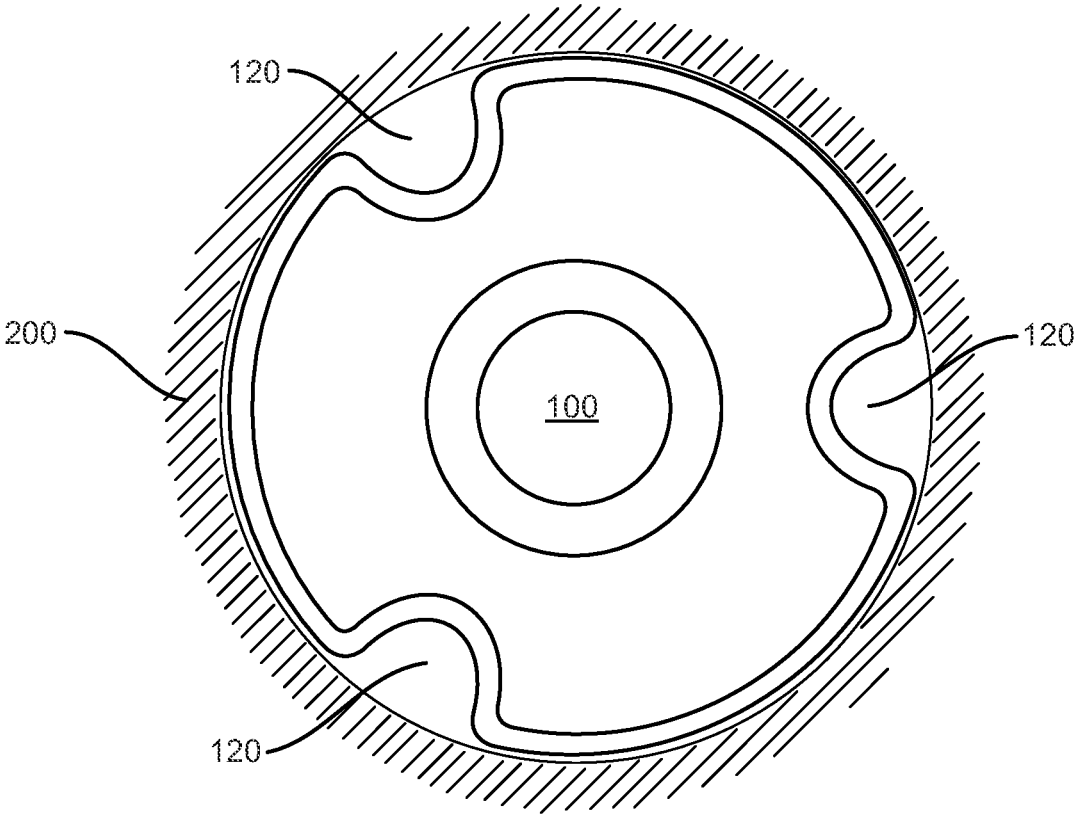
FIG. 11 depicts a cross-sectional view, in a simplified condition, illustrating a compliance of the swept ventilation channels as the eartip conforms to a medium diameter to form a secondary acoustic channel, in accordance with various embodiments.
Figure 12:
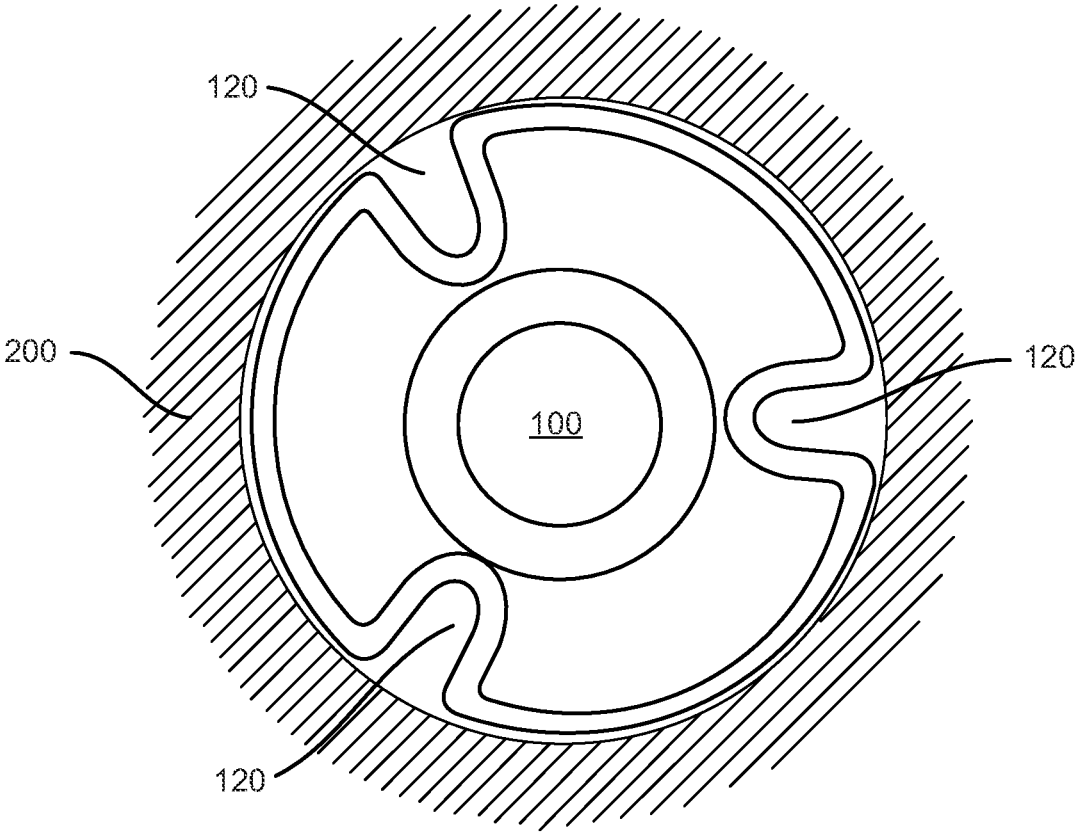
FIG. 12 depicts a cross-sectional view, in a simplified condition, illustrating a compliance of the swept ventilation channels as the eartip conforms to a small diameter to form a secondary acoustic channel, in accordance with various embodiments.
Figure 13:
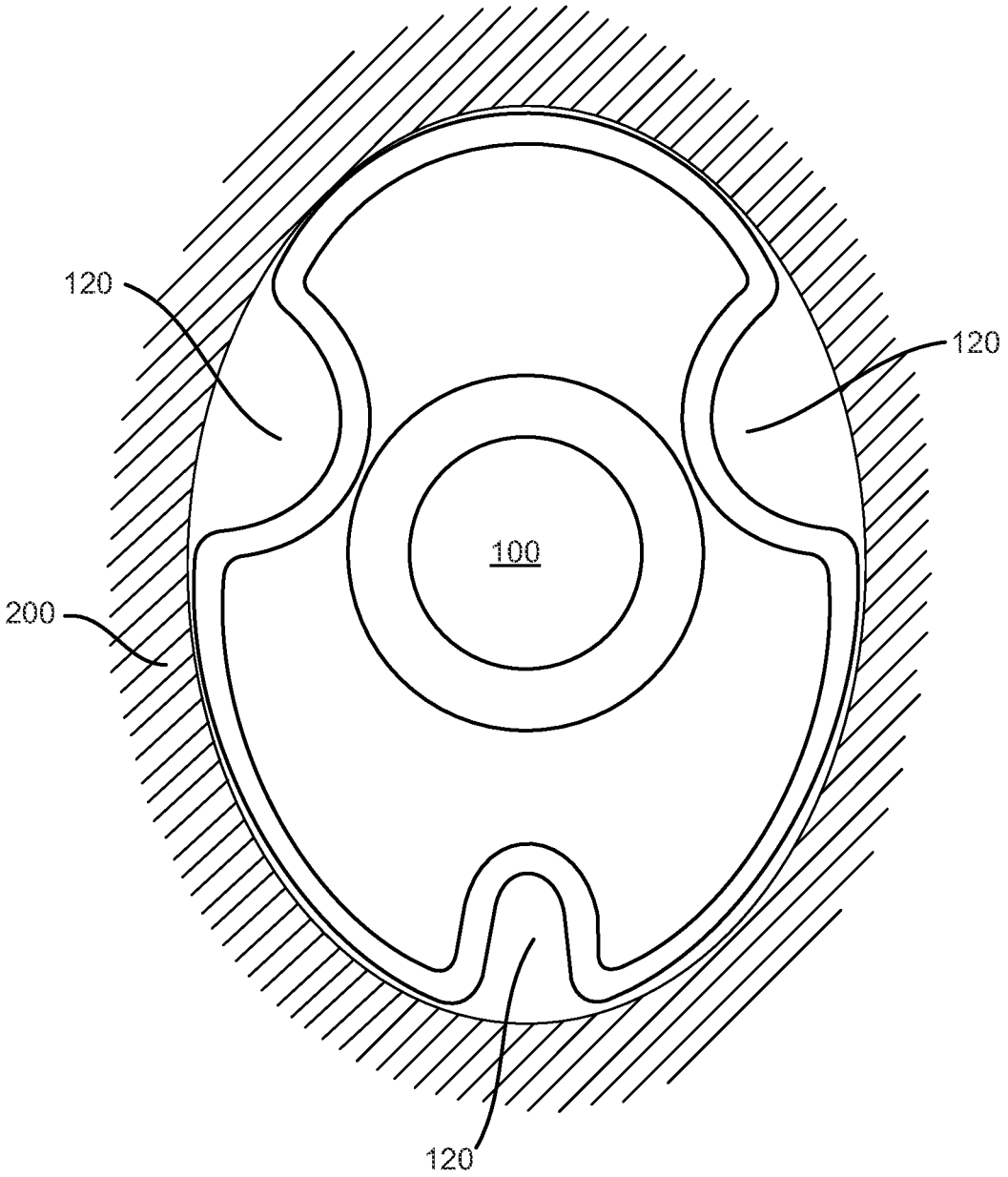
FIG. 13 depicts a cross-sectional view, in a simplified condition, illustrating a compliance of the swept ventilation channels as the eartip conforms to an oblong shape to form a secondary acoustic channel, in accordance with various embodiments.

The swept depressions 110 maintain a secondary acoustic channel 120 to an ambient environment regardless of a shape and effective diameter of the ear canal within which it is placed. For example, FIG. 10 depicts a cross-sectional view, in a simplified condition, illustrating a compliance of the swept ventilation channels 110 as the eartip 100 conforms to a large diameter 200 to form a secondary acoustic channel 120, in accordance with various embodiments. FIG. 11 depicts a cross-sectional view, in a simplified condition, illustrating a compliance of the swept ventilation channels 110 as the eartip 100 conforms to a medium diameter 200 to form a secondary acoustic channel 120, in accordance with various embodiments. FIG. 12 depicts a cross-sectional view, in a simplified condition, illustrating a compliance of the swept ventilation channels 110 as the eartip 100 conforms to a small diameter 200 to form a secondary acoustic channel 120, in accordance with various embodiments. FIG. 13 depicts a cross-sectional view, in a simplified condition, illustrating a compliance of the swept ventilation channels 110 as the eartip 100 conforms to an oblong shape 200 to form a secondary acoustic channel 120, in accordance with various embodiments.

Referring to FIGS. 10-12, an eartip 100 is shown inserted into an object 200, such as an ear canal, having a large (e.g., FIG. 10), medium (e.g., FIG. 11), and small (e.g., FIG. 12) diameter. Referring to FIG. 13, the eartip 100 is shown inserted into an object 200, such as an ear canal, having an oblong shape. As shown in FIGS. 10-13, the configuration of the swept depressions 110 and the elastomer material of the conformable eartip 100 ensures that as the outside flange 106 of the eartip 100 is compressed in its circumference, the swept depressions 110 conform to the pressure applied before the outer flanges 106 are forced to comply. As the eartip 100 is placed into a diameter constricting ear canal 200, the swept depressions 110 conform by increasing the effective depth and decreasing the effective width of the channel 120. This conforming action, which maintains the secondary acoustic channel 120, ensures that an acoustic seal is not created between the outer flange 106 and the ear canal 200. As the eartip 100 is placed into a diameter constricting ear canal 200, at least one of the swept depressions 110 remains open to form the secondary acoustic channel 120 from the ambient environment across the eartip 100.

Figure 14:
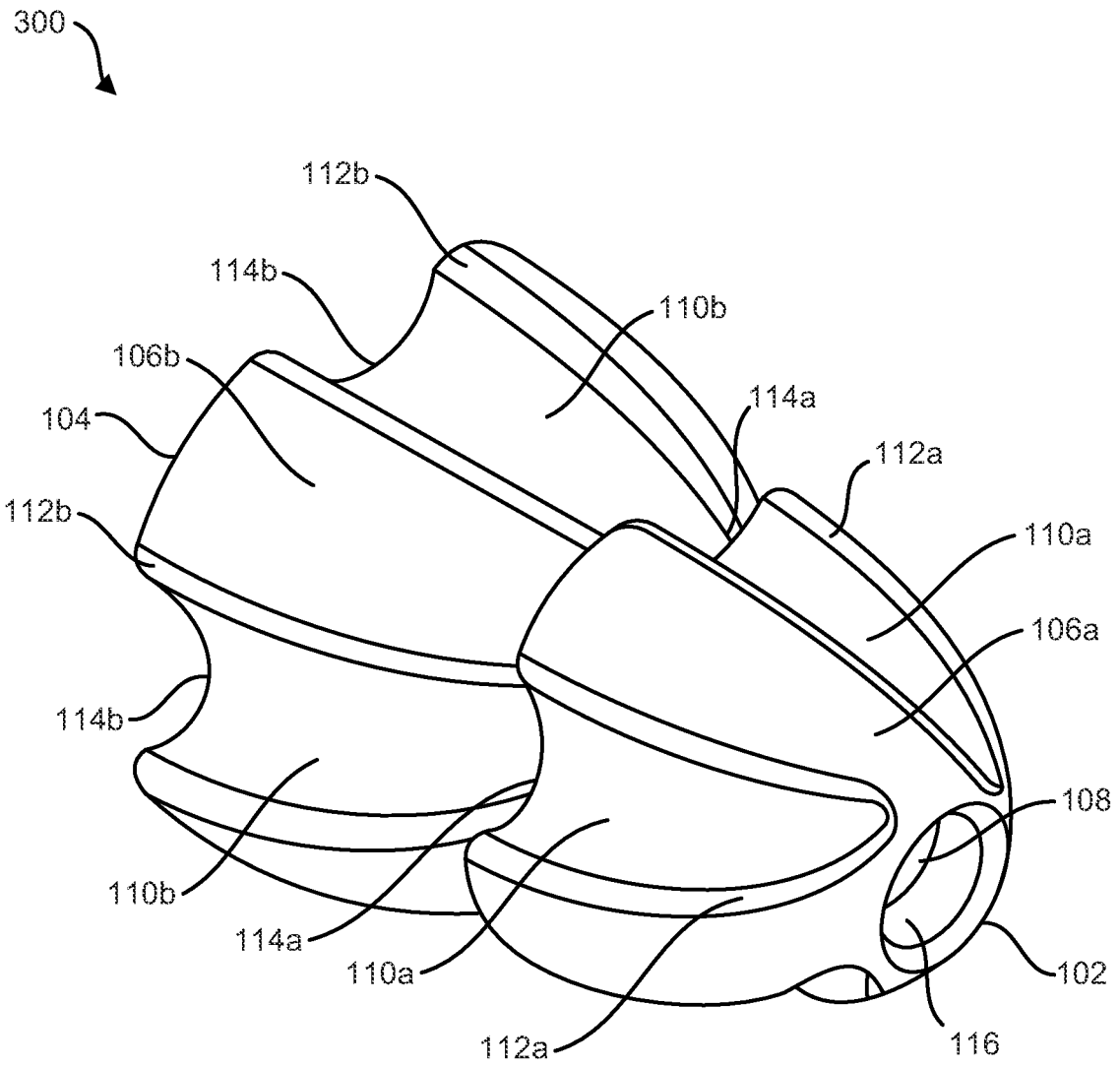
FIG. 14 depicts a front perspective view of an exemplary two-flange conformable vented eartip, each flange having four sloped ventilation channels configured to maintain a secondary acoustic channel to an ambient environment, in accordance with various embodiments.
Figure 15:
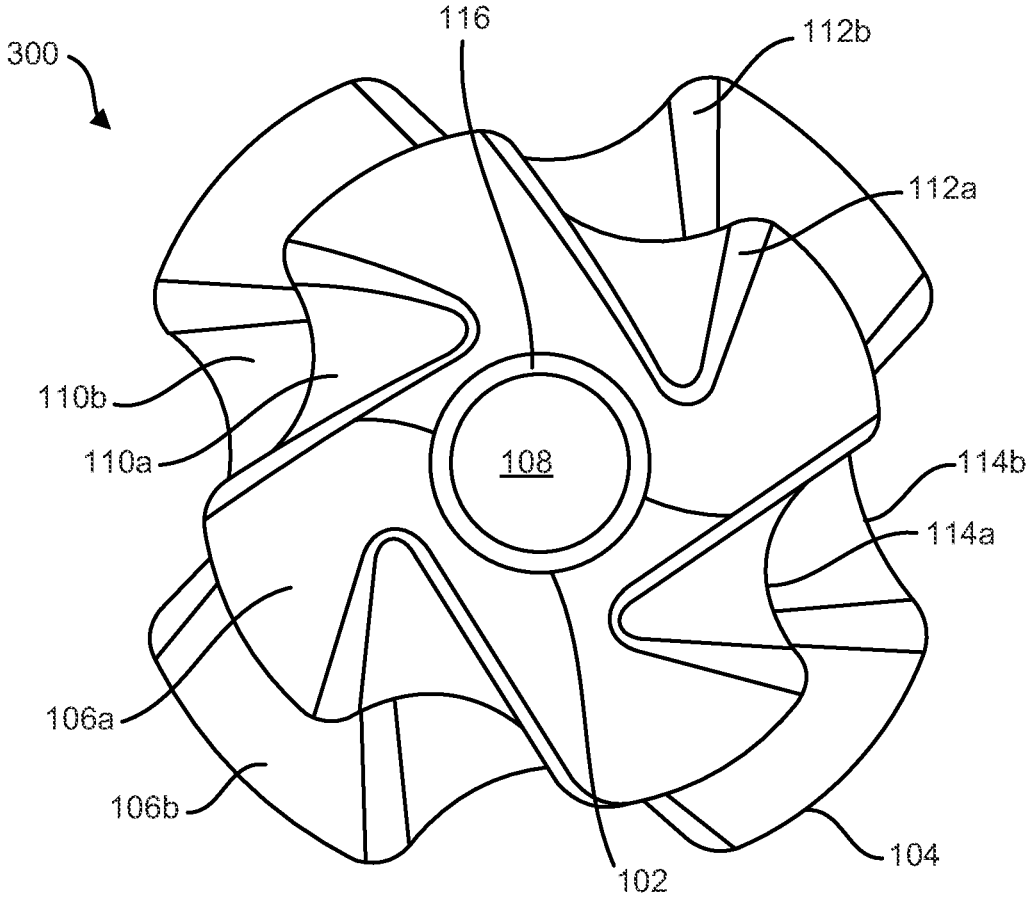
FIG. 15 depicts a top view of an exemplary two-flange conformable vented eartip, each flange having four sloped ventilation channels configured to maintain a secondary acoustic channel to an ambient environment, in accordance with various embodiments.
Figure 16:
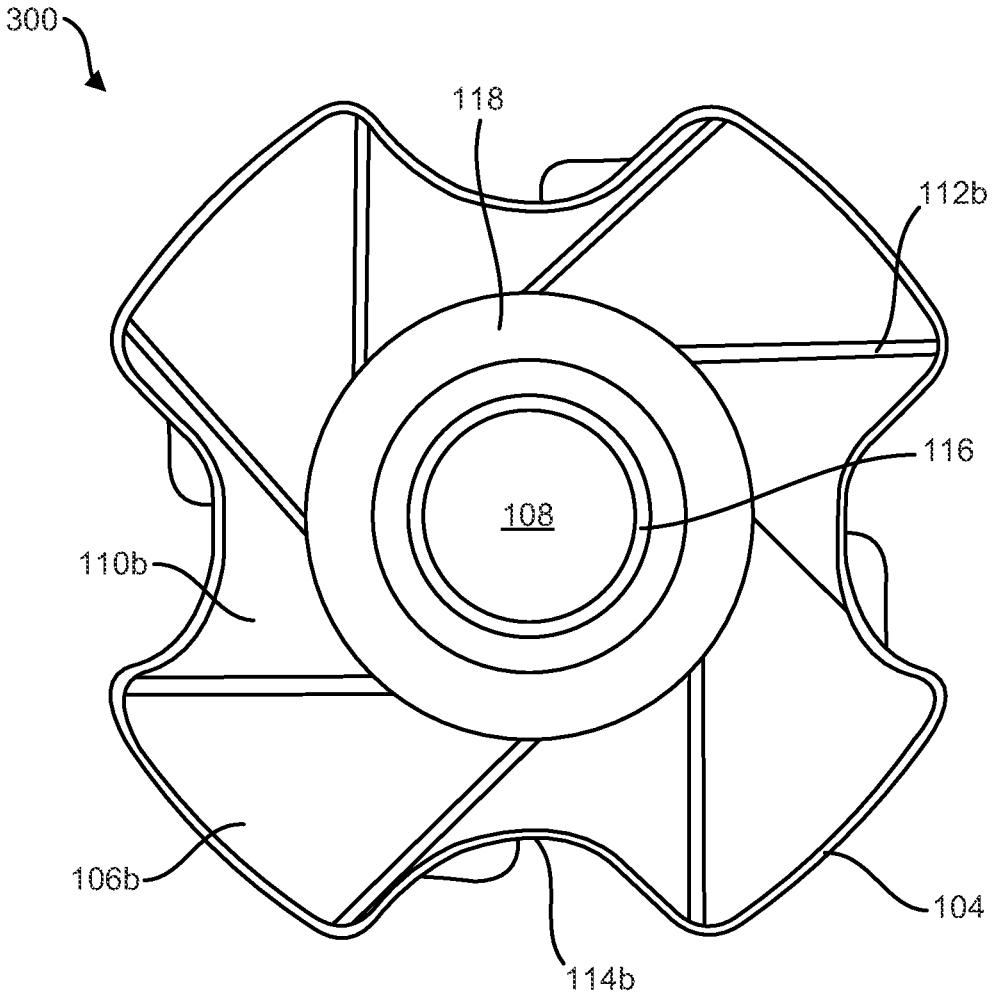
FIG. 16 depicts a bottom view of an exemplary two-flange conformable vented eartip having a stem configured to receive a sound tube of an earphone or hearing aid, and with each flange having four sloped ventilation channels configured to maintain a secondary acoustic channel to an ambient environment, in accordance with various embodiments.
Figure 17:
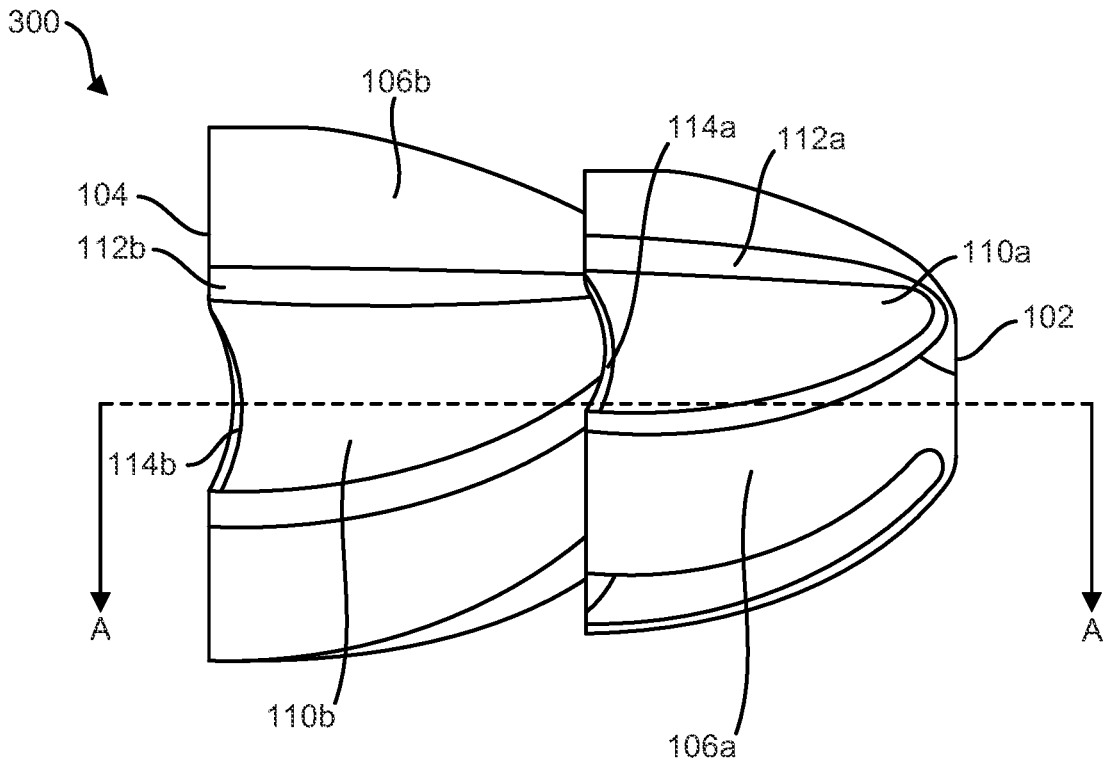
FIG. 17 depicts a side elevation view of an exemplary two-flange conformable vented eartip, each flange having four sloped ventilation channels configured to maintain a secondary acoustic channel to an ambient environment, in accordance with various embodiments.
Figure 18:
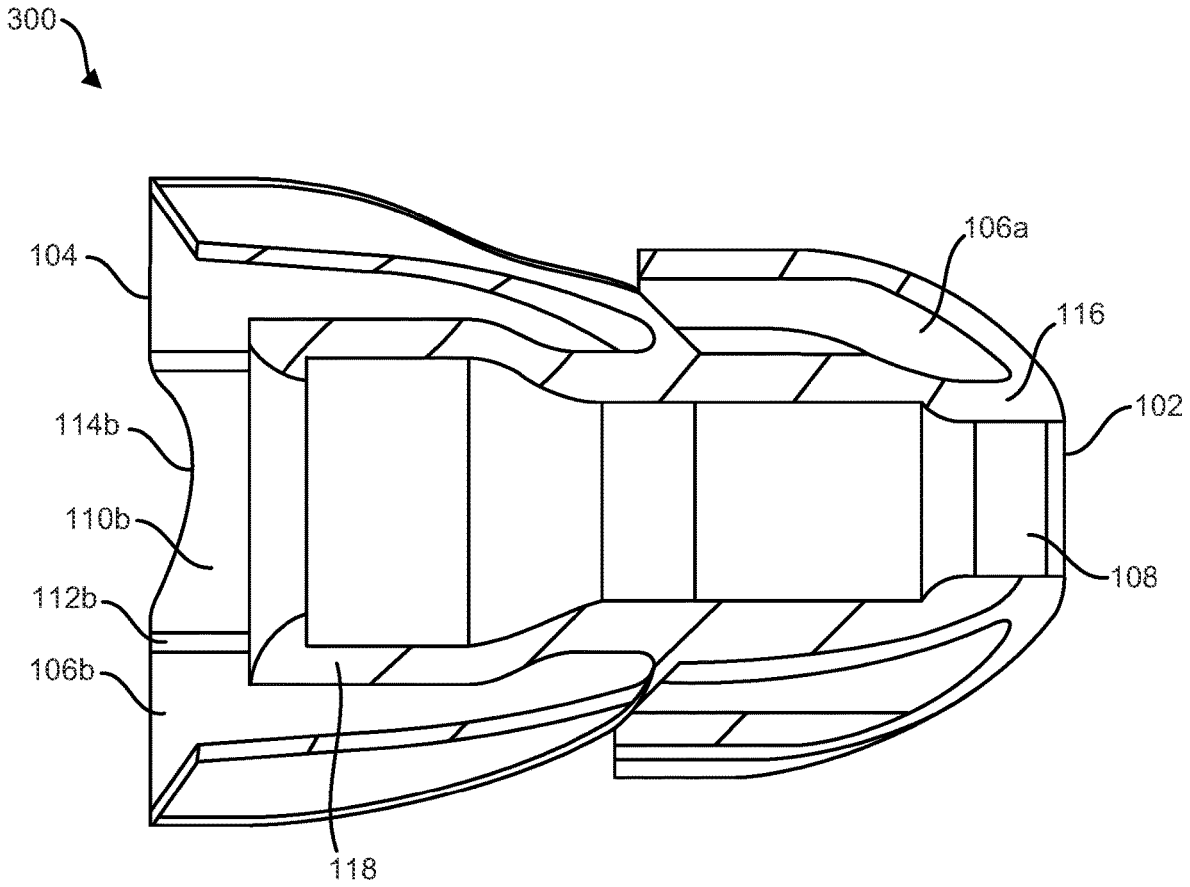
FIG. 18 depicts a cross-sectional view along line A-A of FIG. 16 of an exemplary two-flange conformable vented eartip having a stem configured to receive a sound tube of an earphone or hearing aid, and with each flange having four sloped ventilation channels configured to maintain a secondary acoustic channel to an ambient environment, in accordance with various embodiments.
Figure 19:
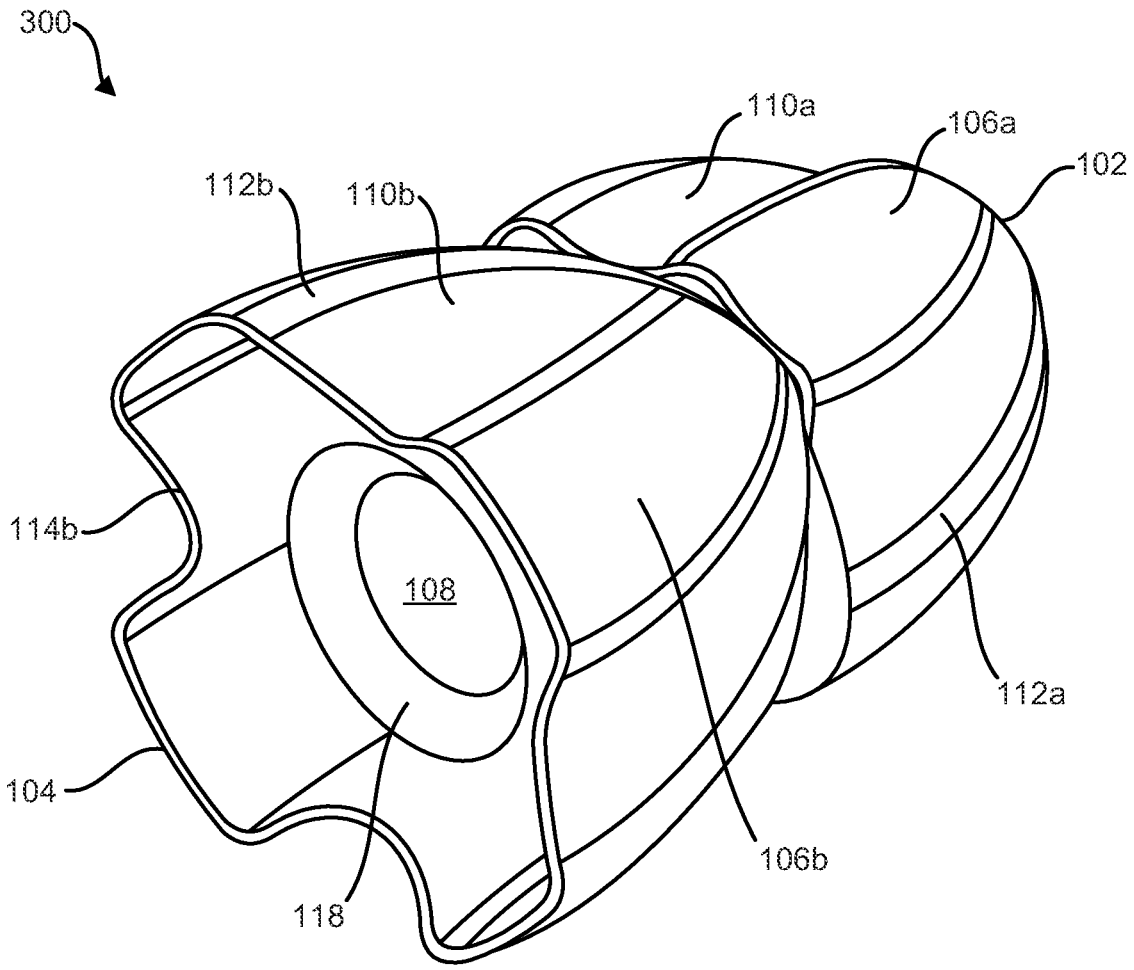
FIG. 19 depicts a rear perspective view of an exemplary two-flange conformable vented eartip having a stem configured to receive a sound tube of an earphone or hearing aid, and with each flange having four sloped ventilation channels configured to maintain a secondary acoustic channel to an ambient environment, in accordance with various embodiments.

FIG. 14 depicts a front perspective view of an exemplary two-flange conformable vented eartip 300, each flange 106*a*, 106*b* having four sloped ventilation channels 110*a*, 110*b* configured to maintain a secondary acoustic channel 120 to an ambient environment, in accordance with various embodiments. FIG. 15 depicts a top view of an exemplary two-flange conformable vented eartip 300, each flange 106*a*, 106*b* having four sloped ventilation channels 110*a*, 110*b* configured to maintain a secondary acoustic channel 120 to an ambient environment, in accordance with various embodiments. FIG. 16 depicts a bottom view of an exemplary two-flange conformable vented eartip 300 having a stem 118 configured to receive a sound tube of an earphone or hearing aid, and with each flange 106*a*, 106*b* having four sloped ventilation channels 110*a*, 110*b* configured to maintain a secondary acoustic channel 120 to an ambient environment, in accordance with various embodiments. FIG. 17 depicts a side elevation view of an exemplary two-flange conformable vented eartip 300, each flange 106*a*, 106*b* having four sloped ventilation channels 110*a*, 110*b* configured to maintain a secondary acoustic channel 120 to an ambient environment, in accordance with various embodiments. FIG. 18 depicts a cross-sectional view along line A-A of FIG. 16 of an exemplary two-flange conformable vented eartip 300 having a stem 118 configured to receive a sound tube of an earphone or hearing aid, and with each flange 106*a*, 106*b* having four sloped ventilation channels 110*a*, 110*b* configured to maintain a secondary acoustic channel 120 to an ambient environment, in accordance with various embodiments. FIG. 19 depicts a rear perspective view of an exemplary two-flange conformable vented eartip 300 having a stem 118 configured to receive a sound tube of an earphone or hearing aid, and with each flange 106*a*, 106*b* having four sloped ventilation channels 110*a*, 110*b* configured to maintain a secondary acoustic channel 120 to an ambient environment, in accordance with various embodiments.

Referring to FIGS. 14-19, two-flange conformable vented eartips 300 are shown. The conformable vented eartips 300 may be made of an elastomer material, such as silicone, or any suitable material. The conformable vented eartips 300 may include an ear insertion end 102 and an earphone insertion end 104 opposite the ear insertion end 102. The conformable vented eartips 300 may include two or more flanges 106*a*, 106*b* and a base 116, 118 having an eartip collar 116. In various embodiments, an eartip stem 118 may extend from the eartip collar 116 (as shown in FIGS. 16, 18, and 19). Alternatively, the eartip 300 may include an eartip collar 116 without an eartip stem 118. The eartip collar 116 and stem 118 (if present) includes a central opening 108 extending from the ear insertion end 102 toward the earphone insertion end 104 to form an inner, primary sound channel 108. The eartip collar 116 and/or stem 118 (if present) may be configured to receive and hold a sound tube of an earphone or hearing aid within the inner, primary sound channel 108.

A first 106*a* of the two or more flanges 106*a*, 106*b* may extend from the base 116, 118 at the ear insertion end 102 at an angle away from the base 116, 118 and toward the earphone insertion end 104. A second 106*b* of the two or more flanges 106*a*, 106*b* may extend from a position on the base 116, 118 between the ear insertion end 102 and the earphone insertion end 104 at an angle away from the base 116, 118 and toward the earphone insertion end 104. Integrated into each of the flanges 106*a*, 106*b* of the eartip 300 are a series of swept indents 110*a*, 110*b* (also referred to as swept depressions and swept ventilation channels) leading from the narrower end of each of the flanges 106*a*, 106*b* towards the larger end of each of the flanges 106*a*, 106*b*, maintaining a depression 110*a*, 100*b* relative to the outer circumference, which follows the outward taper of the respective flange 106*a*, 106*b* while sweeping laterally around the circumference. The transition between the outer surface of each of the flanges 106*a*, 106*b* and the swept depressions 110*a*, 110*b* may comprise rounded corners 112*a*, 112*b*. The swept depressions 110*a*, 110*b* of each flange 106*a*, 106*b* may be notched 114 at the earphone insertion end 104 of each flange 106*a*, 106*b*. The swept indents 110*a* of the first flange 106*a* and the swept indents 110*b* of the second flange 106*b* may be aligned so as to maintain the secondary acoustic channel 120 when the flanges 106*a*, 106*b* are compressed as inserted into an ear canal. Although four (4) swept depressions 110*a*, 110*b* are shown in each flange 106*a*, 106*b* in FIGS. 14-19, more (e.g., 5-10) or less (e.g., 1-3) swept depressions 110*a*, 110*b* are contemplated. Although the swept indents 110*a*, 110*b*, as shown in FIGS. 14-19, follow a counterclockwise path, swept indents 110*a*, 100*b* along a clockwise path is also envisioned as an alternate embodiment. In various embodiments, the angle and length of the path of the swept indents 110*a*, 110*b* may vary. Moreover, the depth and taper of the depth along the path of the swept indent 110*a*, 110*b* may be configured to provide larger or smaller acoustic channels 120. Furthermore, the swept indents 110*a*, 110*b* may be configured to provide the acoustic channels 120 on an eartip 300 designed to accommodate larger or smaller ear canal contours. The swept depressions 110*a*, 110*b* maintain a secondary acoustic channel 120 to an ambient environment regardless of a shape and effective diameter of the ear canal within which it is placed, as shown in FIGS. 10-13 and described above.

Referring to FIGS. 1-19, in an exemplary embodiment, the flange 106 may have a diameter and may extend at an angle from the base 116, 118 at the ear insertion end 102. In embodiments having multiple flanges 106*a*, 106*b*, the additional flange(s) 106*b* may have progressively larger diameters (e.g., approximately 0.5-1.5 millimeters larger than the previous flange 106*a* toward the ear insertion end 102 of the eartip 100) and/or angles. For example, an angle of a first or single flange 106, 106*a* may be approximately 32 degrees (defined as between 26 and 36 degrees). In a two-flange embodiment 300, the second flange 106*b* may have an angle of approximately 40 degrees (defined as between 34 and 44 degrees). Although one flange 106 is shown in FIGS. 1-9 and two flanges 106*a*, 106*b* are shown in FIGS. 14-19, additional flanges (e.g., 3 flanges) are contemplated.

In various embodiments, the flange wall(s) 106, 106*a*, 106*b* may be thin walls constructed from a low-durometer (i.e., in the range of 25 to 45 Shore A) elastomer to allow the flange wall(s) 106, 106*a*, 106*b* to be highly conformable. In an exemplary embodiment, the flange wall(s) 106, 106*a*, 106*b* may have a thickness of approximately 0.5 millimeters (defined as 0.4 to 0.6 millimeters). In certain embodiments, the thickness of the flange wall(s) 106, 106*a*, 106*b* may not be constant.

In various embodiments, the eartips 100, 300 may be provided in different sizes, such as extra-large, large, medium, and small. As an example, the extra-large eartip 100, 300 may have a flange 106 (or front flange 106*a*) diameter of approximately 12 millimeters (i.e., 11.5-12.5 millimeters), the large eartip 100, 300 may have a flange 106 (or front flange 106*a*) diameter of approximately 11 millimeters (i.e., 10.5-11.5 millimeters), the medium eartip 100, 300 may have flange 106 (or front flange 106*a*) diameter of approximately 10 millimeters (i.e., 9.5-10.5 millimeters), and the small eartip 100, 300 may have a flange 106 (or front flange 106*a*) diameter of approximately 9 millimeters (i.e., 8.5-9.5 millimeters). Although four eartip sizes are discussed above, more or less eartip sizes having different flange diameters are contemplated.

Figure 20:
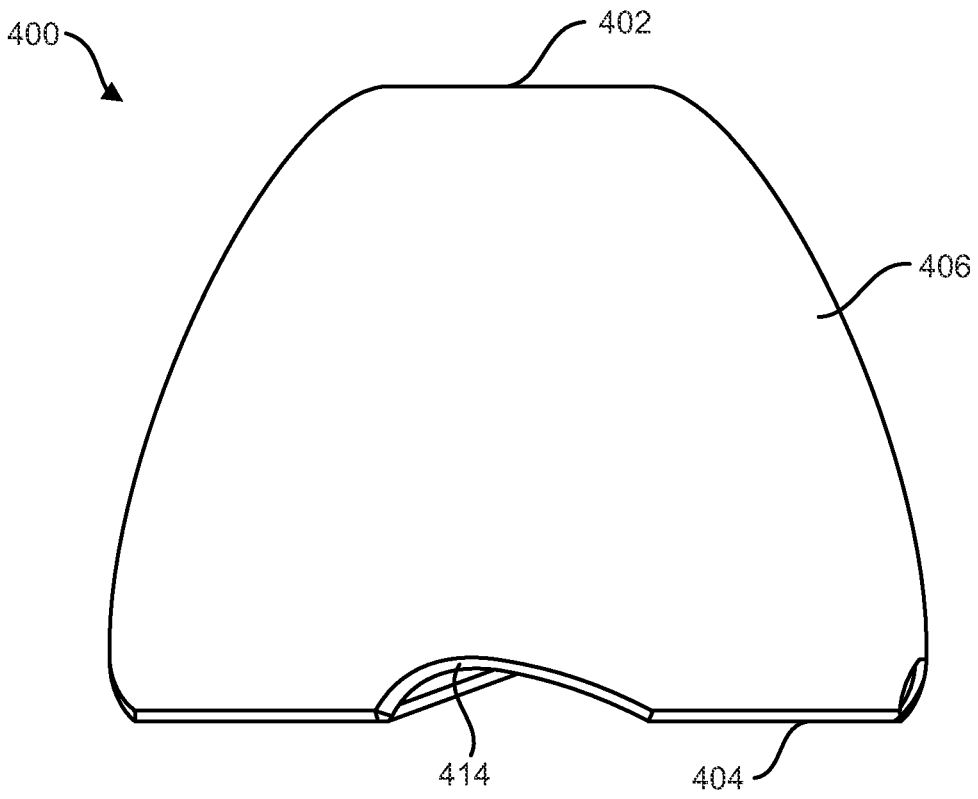
FIG. 20 depicts a side elevation view of an exemplary single-flange conformable sealing eartip, in accordance with various embodiments.
Figure 21:
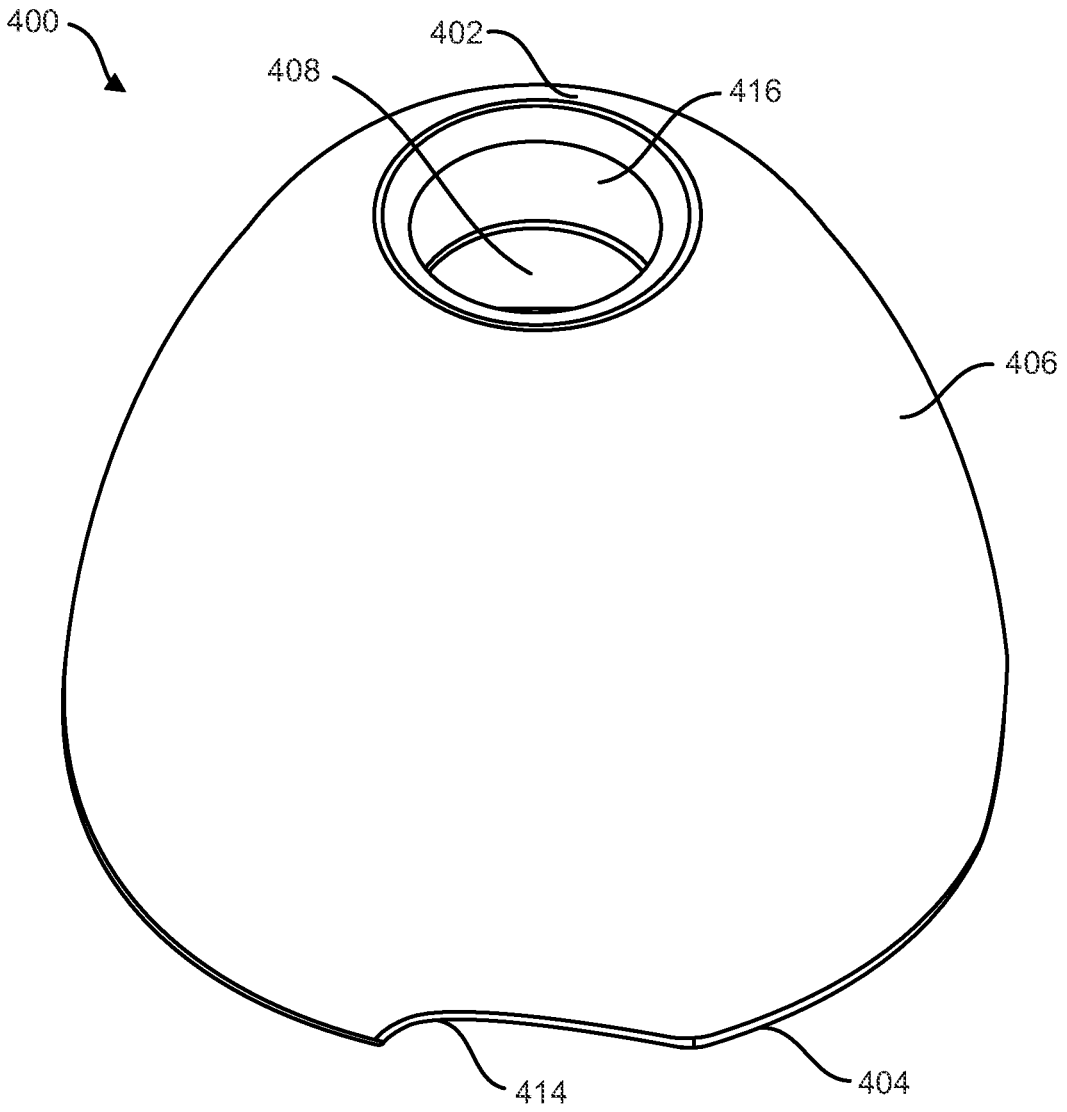
FIG. 21 depicts a top perspective view of an exemplary single-flange conformable sealing eartip, in accordance with various embodiments.
Figure 22:
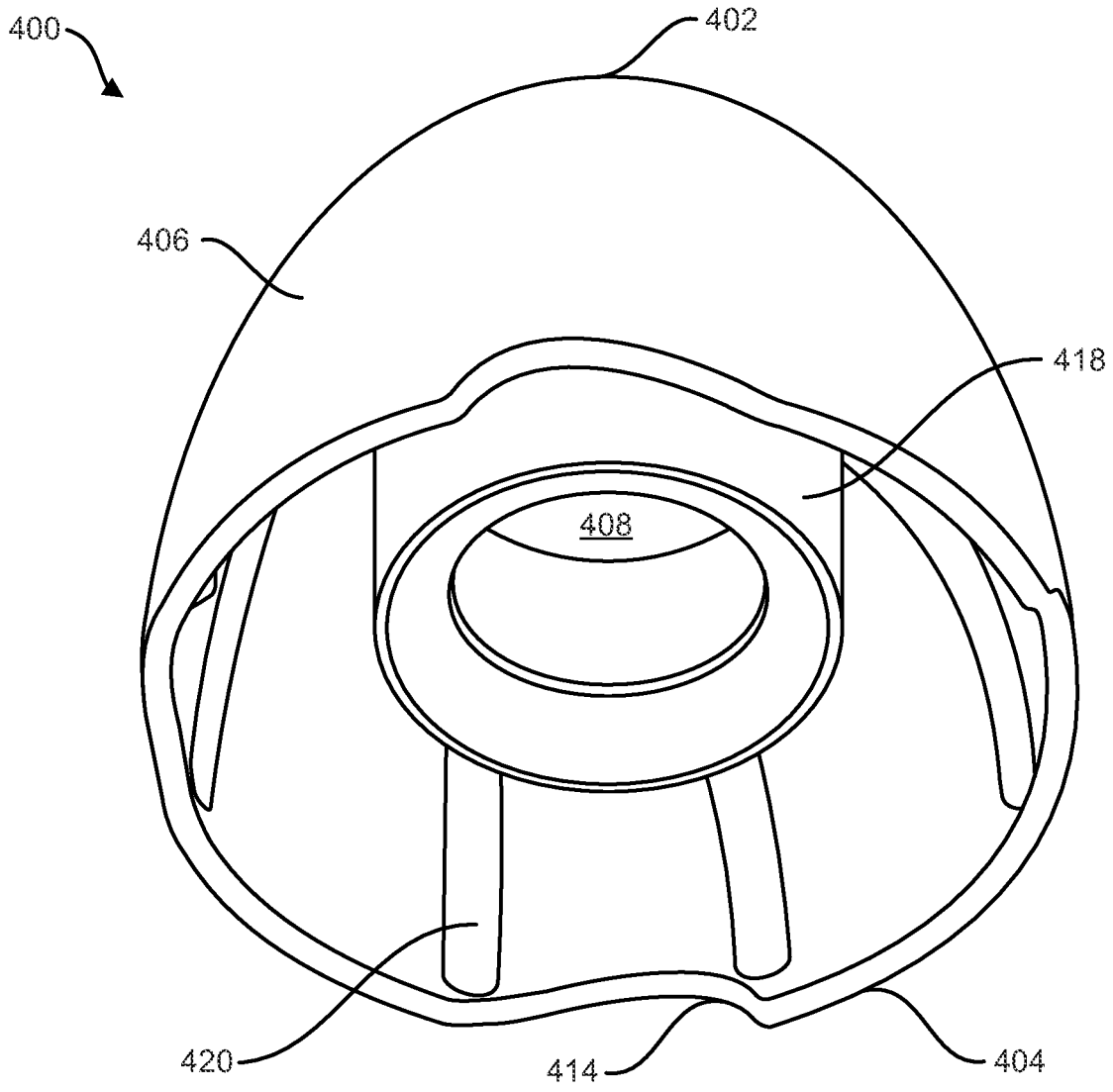
FIG. 22 depicts a bottom perspective view of an exemplary single-flange conformable sealing eartip having a stem configured to receive a sound tube of an earphone or hearing aid, in accordance with various embodiments.
Figure 23:
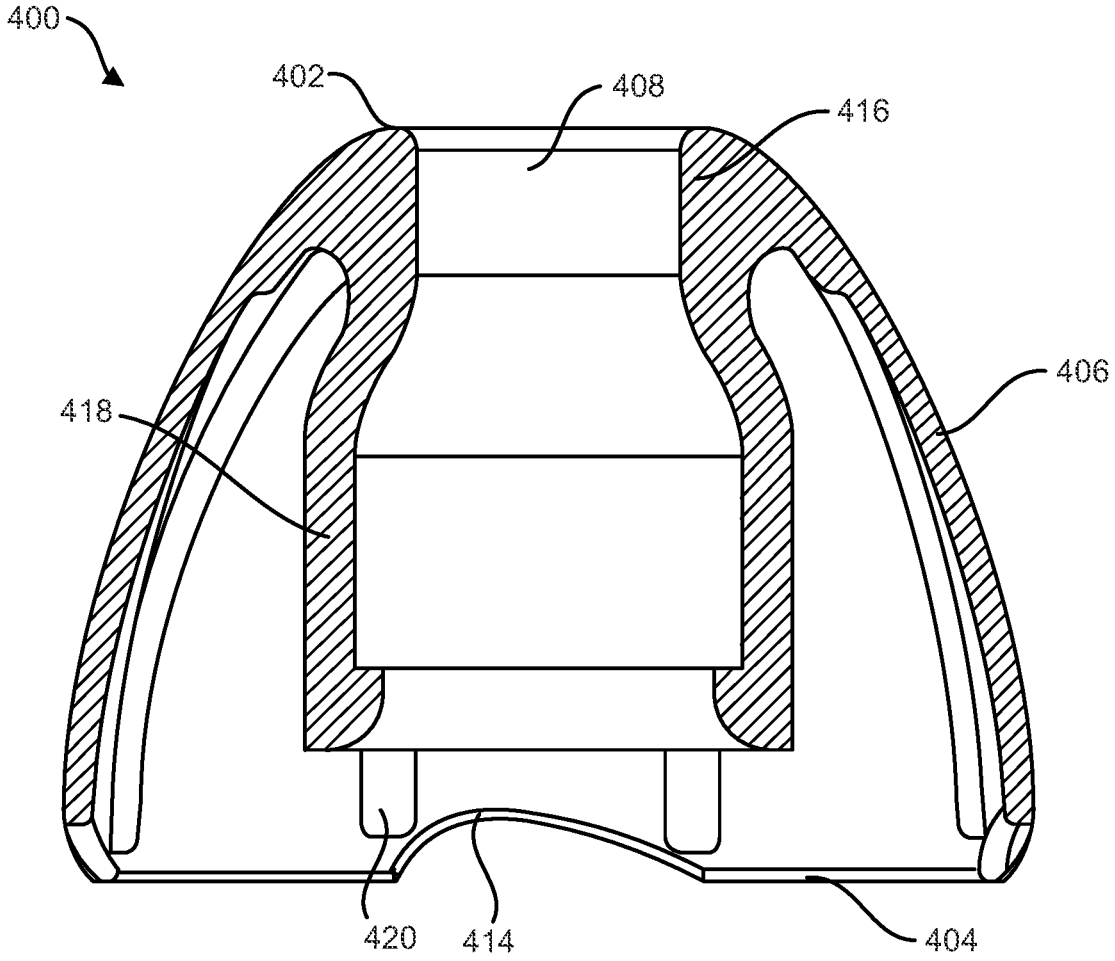
FIG. 23 depicts a cross-sectional view of an exemplary single-flange conformable sealing eartip having a stem configured to receive a sound tube of an earphone or hearing aid, in accordance with various embodiments.

FIG. 20 depicts a side elevation view of an exemplary single-flange conformable sealing eartip 400, in accordance with various embodiments. FIG. 21 depicts a top perspective view of an exemplary single-flange conformable sealing eartip 400, in accordance with various embodiments. FIG. 22 depicts a bottom perspective view of an exemplary single-flange conformable sealing eartip 400 having a stem 418 configured to receive a sound tube of an earphone or hearing aid, in accordance with various embodiments. FIG. 23 depicts a cross-sectional view of an exemplary single-flange conformable sealing eartip 400 having a stem 418 configured to receive a sound tube of an earphone or hearing aid, in accordance with various embodiments.

Referring to FIGS. 20-23, conformable sealing eartips 400 are shown, as opposed to the conformable vented eartips 100, 300 shown in FIGS. 1-19 as described above in the preferred embodiments. The conformable sealing eartips 400 may share various characteristics with the conformable vented eartips 100, 300 described above, with the exception of the at least one flange 406 of the conformable sealing eartips 400 do not include swept indents 110 and rounded corners 112 as described above with respect to the conformable vented eartips 100, 300. Instead, the conformable sealing eartips 400 may optionally include ribs 420 on an inner surface of the at least one flange 406 to mimic the appearance of the conformable vented eartips 100, 300 if, for example, the conformable sealing eartips 400 are made of a translucent material.

The conformable sealing eartips 400 may be made of an elastomer material, such as silicone, or any suitable material. The conformable sealing eartips 400 may include an ear insertion end 402 and an earphone insertion end 404 opposite the ear insertion end 402. The conformable sealing eartips 400 may include at least one flange 406 and a base 416, 418 having an eartip collar 416. In various embodiments, an eartip stem 418 may extend from the eartip collar 416 (as shown in FIGS. 22 and 23). Alternatively, the eartip 400 may include an eartip collar 416 without an eartip stem 418. The eartip collar 416 and stem 418 (if present) includes a central opening 408 extending from the ear insertion end 402 toward the earphone insertion end 404 to form an inner, primary sound channel 408. The eartip collar 416 and/or stem 418 (if present) may be configured to receive and hold a sound tube of an earphone or hearing aid within the inner, primary sound channel 108. The at least one flange 406 may extend from the base 416, 418 at the ear insertion end 402 at an angle away from the base 416, 418 and toward the earphone insertion end 404. Although the conformable sealing eartip 400 is shown with one flange 406, more flanges 406 (e.g., 2 or 3 flanges) are contemplated. The conformable sealing eartip 400 that can conform comfortably to the individual ear canal while easily creating and maintaining a sealing surface at each flange 406 to the wall of the ear canal 200 (i.e., without secondary acoustic channels).

Aspects of the present disclosure provide a comfortable vented eartip 100, 300 comprising an ear insertion end 102, an earphone insertion end 104, a base 116, 118, a central opening 108, and at least one flange 106, 106*a*, 106*b*. The earphone insertion end 104 is opposite the ear insertion end 102. The base 116, 118 is at the ear insertion end 102 and extends toward the earphone extension end 104. The central opening 108 extends through the base 116, 118 to form an inner sound channel 108 through the base 116, 118. The at least one flange 106, 106*a*, 106*b* includes a first flange end extending from the base 116, 118 at an angle away from the base 116, 118 and toward the earphone insertion end 104 at a second flange end. The at least one flange 106, 106*a*, 106*b* comprises at least one swept indent 110, 110*a*, 110*b* extending between the first flange end and the second flange end. The at least one swept indent 110, 110*a*, 110*b* sweeps laterally around a portion of a circumference of the at least one flange 106, 106*a*, 106*b*.

In an exemplary embodiment, the base 116, 118 comprises a collar 116 configured to receive and hold a sound tube of an earphone or hearing aid. In a representative embodiment, the base 116, 118 comprises a collar 116 and a stem 118 extending from the collar 116 toward the earphone insertion end 104. One or both of the collar 116 and the stem 118 is configured to receive and hold a sound tube of an earphone or hearing aid. In various embodiments, one or both of the collar 116 and the stem 118 is shaped to receive the sound tube of the earphone or hearing aid at one or both of a particular position or particular orientation within the inner sound channel 108. In certain embodiments, the at least one swept indent 110, 110*a*, 110*b* comprises a first indent end toward the first flange end and a second indent end toward the second flange end. The first indent end includes a first indent width. The second indent end includes a second indent width. The first indent width is less than the second indent width. In an exemplary embodiment, the at least one swept indent 110, 110*a*, 110*b* comprises a first indent end toward the first flange end and a second indent end toward the second flange end. A width of the at least one swept indent 110, 110*a*, 110*b* tapers from the second indent end to the first indent end. In a representative embodiment, the at least one swept indent 110, 110*a*, 110*b* is one of three swept indents or four swept indents. In various embodiments, the at least one swept indent 110, 100*a*, 110*b* comprises a first indent end toward the first flange end and a second indent end toward the second flange end. The second indent end comprises a notch 114, 114*a*, 114*b*. In certain embodiments, a transition between an outer surface of the at least one flange 106, 106*a*, 106*b* and the at least one swept indent 110, 110*a*, 110*b* comprises rounded corners 112, 112*a*, 112*b*.

In a representative embodiment, the at least one swept indent 110, 110*a*, 110*b* follows a counterclockwise path. In an exemplary embodiment, the at least one swept indent 110, 110*a*, 110*b* follows a clockwise path. In various embodiments, an effective depth of the at least one swept indent 110, 110*a*, 110*b* is configured to increase and an effective width of the at least one swept indent 110, 110*a*, 110*b* is configured to decrease to maintain a secondary acoustic channel 120 between the ear insertion end 102 and the earphone insertion end 104 and preventing an acoustic seal between the at least one flange 106, 106*a*, 106*b* and a diameter constricting ear canal 200 when the conformable vented eartip 100, 300 is inserted into the diameter constricting ear canal 200. In certain embodiments, the at least one flange 106, 106*a*, 106*b* is a single flange 106.

In various embodiments, the at least one flange 106, 106*a*, 106*b* is two flanges 106*a*, 106*b* comprising a front flange 106*a* and a rear flange 106*b*. The at least one swept indent 110*a* of the front flange 106*a* is aligned with the at least one swept indent 110*b* of the rear flange 106*b*. In an exemplary embodiment, the at least one flange 106, 106*a*, 106*b* is two flanges 106*a*, 106*b* comprising a front flange 106*a* and a rear flange 106*b*. The front flange 106*a* extends from the base 116, 118 at the ear insertion end 102 at a first angle and the rear flange 106*b* extends from the base 116, 118 offset from the ear insertion end 102 toward the earphone insertion end 104. The rear flange 106*b* extends toward the earphone insertion end 104 at a second angle that is greater than the first angle. In a representative embodiment, the first angle is 26 to 36 degrees and the second angle is 34 to 44 degrees.

In certain embodiments, the at least one flange 106, 106*a*, 106*b* is two flanges 106*a*, 106*b* comprising a front flange 106*a* and a rear flange 106*b*. The front flange 106*a* includes a first diameter and the rear flange 106*b* includes a second diameter that is larger than the first diameter. In various embodiments, a thickness of the at least one flange 106, 106*a*, 106*b* is 0.4 to 0.6 millimeters. In an exemplary embodiment, a thickness of the at least one flange 106, 106*a*, 106*b* is not constant. In a representative embodiment, the at least one flange 106, 106*a*, 106*b* is an elastomer material having a durometer of 25 to 45 Shore A.

As utilized herein, "and/or" means any one or more of the items in the list joined by "and/or". As an example, "x and/or y" means any element of the three-element set {(x), (y), (x, y)}. As another example, "x, y, and/or z" means any element of the seven-element set {(x), (y), (z), (x, y), (x, z), (y, z), (x, y, z)}. As utilized herein, the term "exemplary" means serving as a non-limiting example, instance, or illustration. As utilized herein, the terms "e.g.," and "for example" set off lists of one or more non-limiting examples, instances, or illustrations. As utilized herein, a component is "operable" or "configured" to perform a function whenever the component comprises the necessary structure to perform the function, regardless of whether the function is performed.

While the present disclosure has been described with reference to certain embodiments, it will be understood by those skilled in the art that various changes may be made and equivalents may be substituted without departing from the scope of the present disclosure. In addition, many modifications may be made to adapt a particular situation or material to the teachings of the present disclosure without departing from its scope. Therefore, it is intended that the present disclosure not be limited to the particular embodiment disclosed.

What is claimed is:

1. A conformable vented eartip comprising:
an ear insertion end;
an earphone insertion end opposite the ear insertion end;
a base at the ear insertion end extending toward the earphone extension end;
a central opening extending through the base to form an inner sound channel through the base; and
a single flange having a first flange end extending from the base at an angle away from the base and toward the earphone insertion end at a second flange end, the single flange comprising at least one swept indent extending between the first flange end and the second flange end, the at least one swept indent sweeping laterally around a portion of a circumference of the single flange.

2. The conformable vented eartip of claim 1, wherein the base comprises a collar configured to receive and hold a sound tube of an earphone or hearing aid.

3. The conformable vented eartip of claim 1, wherein the base comprises a collar and a stem extending from the collar toward the earphone insertion end, one or both of the collar and the stem configured to receive and hold a sound tube of an earphone or hearing aid.

4. The conformable vented eartip of claim 3, wherein one or both of the collar and the stem is shaped to receive the sound tube of the earphone or hearing aid at one or both of a particular position or particular orientation within the inner sound channel.

5. The conformable vented eartip of claim 1, wherein:
the at least one swept indent comprises a first indent end toward the first flange end and a second indent end toward the second flange end,
the first indent end having a first indent width,
the second indent end having a second indent width, and
the first indent width is less than the second indent width.

6. The conformable vented eartip of claim 1, wherein:
the at least one swept indent comprises a first indent end toward the first flange end and a second indent end toward the second flange end, and
a width of the at least one swept indent tapers from the second indent end to the first indent end.

7. The conformable vented eartip of claim 1, wherein the at least one swept indent is one of three swept indents or four swept indents.

8. The conformable vented eartip of claim 1, wherein:
the at least one swept indent comprises a first indent end toward the first flange end and a second indent end toward the second flange end, and
the second indent end comprises a notch.

9. The conformable vented eartip of claim 1, wherein a transition between an outer surface of the single flange and the at least one swept indent comprises rounded corners.

10. The conformable vented eartip of claim 1, wherein the at least one swept indent follows a counterclockwise path.

11. The conformable vented eartip of claim 1, wherein the at least one swept indent follows a clockwise path.

12. A conformable vented eartip comprising:
an ear insertion end;
an earphone insertion end opposite the ear insertion end;
a base at the ear insertion end extending toward the earphone extension end;
a central opening extending through the base to form an inner sound channel through the base; and
at least one flange having a first flange end extending from the base at an angle away from the base and toward the earphone insertion end at a second flange end, the at least one flange comprising at least one swept indent extending between the first flange end and the second flange end, the at least one swept indent sweeping laterally around a portion of a circumference of the at least one flange,
wherein an effective depth of the at least one swept indent is configured to increase and an effective width of the at least one swept indent is configured to decrease to maintain a secondary acoustic channel between the ear insertion end and the earphone insertion end and preventing an acoustic seal between the at least one flange and a diameter constricting ear canal when the conformable vented eartip is inserted into the diameter constricting ear canal.

13. A conformable vented eartip comprising:
an ear insertion end;
an earphone insertion end opposite the ear insertion end;
a base at the ear insertion end extending toward the earphone extension end;
a central opening extending through the base to form an inner sound channel through the base; and
at least one flange having a first flange end extending from the base at an angle away from the base and toward the earphone insertion end at a second flange end, the at least one flange comprising at least one swept indent extending between the first flange end and the second flange end, the at least one swept indent sweeping laterally around a portion of a circumference of the at least one flange, wherein:

the at least one flange is two flanges comprising a front flange and a rear flange; and the at least one swept indent of the front flange is aligned with the at least one swept indent of the rear flange.

14. A conformable vented eartip comprising:

an ear insertion end;

an earphone insertion end opposite the ear insertion end;

a base at the ear insertion end extending toward the earphone extension end;

a central opening extending through the base to form an inner sound channel through the base; and at least one flange having a first flange end extending from the base at an angle away from the base and toward the earphone insertion end at a second flange end, the at least one flange comprising at least one swept indent extending between the first flange end and the second flange end, the at least one swept indent sweeping laterally around a portion of a circumference of the at least one flange, wherein:

the at least one flange is two flanges comprising a front flange and a rear flange;

the front flange extends from the base at the ear insertion end at a first angle and the rear flange extends from the base offset from the ear insertion end toward the earphone insertion end; and the rear flange extending toward the earphone insertion end at a second angle that is greater than the first angle.

15. The conformable vented eartip of claim 14, wherein:

the first angle is 26 to 36 degrees; and the second angle is 34 to 44 degrees.

16. A conformable vented eartip comprising:

an ear insertion end;

an earphone insertion end opposite the ear insertion end;

a base at the ear insertion end extending toward the earphone extension end;

a central opening extending through the base to form an inner sound channel through the base; and at least one flange having a first flange end extending from the base at an angle away from the base and toward the earphone insertion end at a second flange end, the at least one flange comprising at least one swept indent extending between the first flange end and the second flange end, the at least one swept indent sweeping laterally around a portion of a circumference of the at least one flange, wherein:

the at least one flange is two flanges comprising a front flange and a rear flange; and the front flange includes a first diameter and the rear flange includes a second diameter that is larger than the first diameter.

17. The conformable vented eartip of claim 1, wherein a thickness of the single flange is 0.4 to 0.6 millimeters.

18. The conformable vented eartip of claim 1, wherein a thickness of the single flange is not constant.

19. The conformable vented eartip of claim 1, wherein the single flange is an elastomer material having a durometer of 25 to 45 Shore A.

* * * * *